US010082139B2

(12) United States Patent
Welte et al.

(10) Patent No.: US 10,082,139 B2
(45) Date of Patent: Sep. 25, 2018

(54) PUMP COMPRISING A SPRING

(71) Applicant: Schwäbische Hüttenwerke Automotive GmbH, Aalen-Wasseralfingen (DE)

(72) Inventors: Claus Welte, Aulendorf (DE); Uwe Meinig, Bad Saulgau (DE)

(73) Assignee: Schwäbische Hüttenwerke Automotive GmbH, Aalen-Wasseralfingen (DE)

( * ) Notice: Subject to any disclaimer, the term of this patent is extended or adjusted under 35 U.S.C. 154(b) by 82 days.

(21) Appl. No.: 15/099,986

(22) Filed: Apr. 15, 2016

(65) Prior Publication Data

US 2016/0305428 A1 Oct. 20, 2016

(30) Foreign Application Priority Data

Apr. 17, 2015 (DE) ..... 10 2015 105 933

(51) Int. Cl.
*F03C 2/00* (2006.01)
*F04C 2/00* (2006.01)
(Continued)

(52) U.S. Cl.
CPC ..... *F04C 15/0007* (2013.01); *F01C 19/005* (2013.01); *F01C 21/108* (2013.01);
(Continued)

(58) Field of Classification Search
CPC ..... F04C 15/0007; F04C 15/0023; F04C 15/0034; F04C 2/08; F04C 2/3445;
(Continued)

(56) References Cited

U.S. PATENT DOCUMENTS 2,558,837 A 7/1951 Frei
3,273,503 A 9/1966 Clark et al.
(Continued)

FOREIGN PATENT DOCUMENTS

CN 1500992 6/2004
DE 1553228 10/1970
(Continued)

OTHER PUBLICATIONS

European Patent Office Partial Search Report, EP Patent App. No. 16164888.6-1608, dated Aug. 18, 2016, 7 pages.
(Continued)

*Primary Examiner* — Theresa Trieu
(74) *Attorney, Agent, or Firm* — Luedeka Neely Group, P.C.

(57) ABSTRACT

A pump, comprising a pump insert which is arranged in an accommodating space of a cup-shaped pump housing. The pump insert comprises

Figure 1:
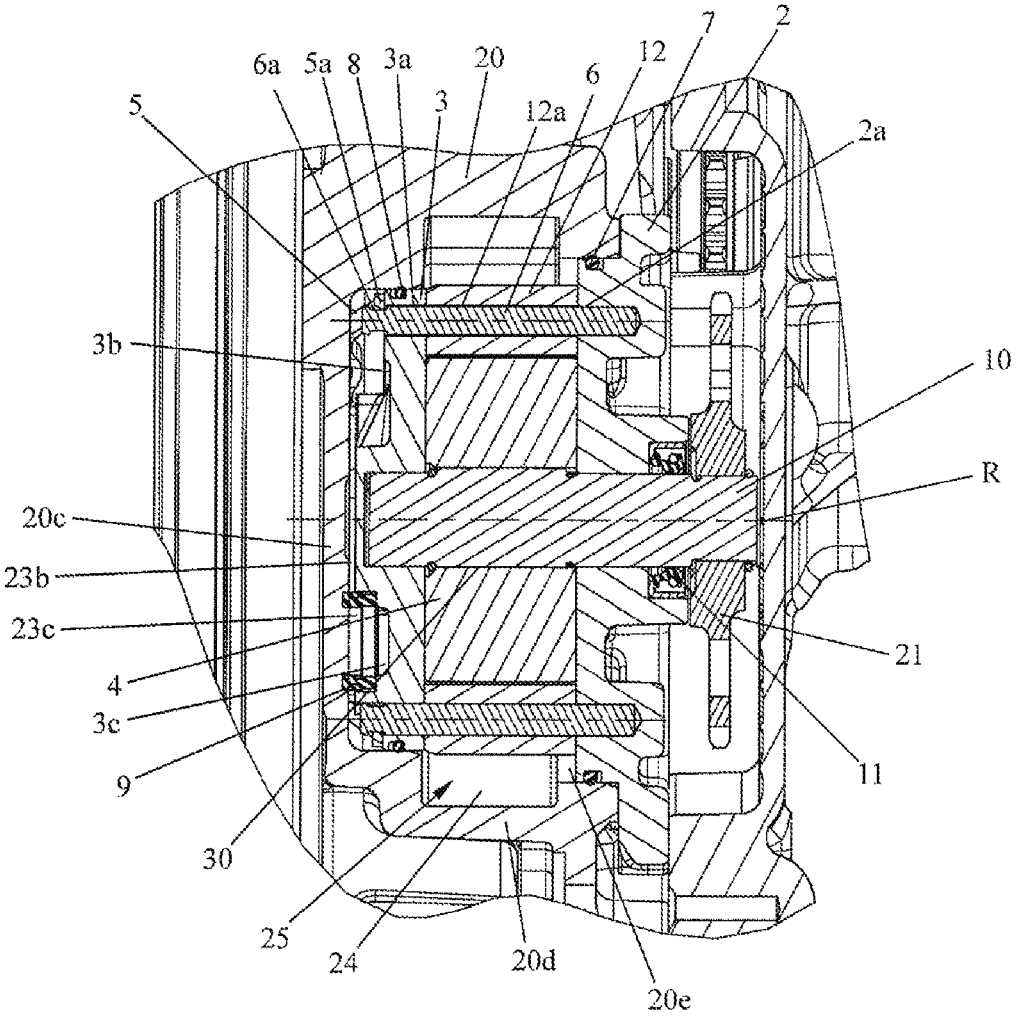

- a first housing part and a second housing part between which a rotor is rotatably arranged, and
- a stroke ring which surrounds the rotor and is arranged between the first housing part and the second housing part.

A spring flexing along the rotational axis is arranged between the accommodating housing and the second housing part. The spring comprises a spring structure which is made of metal and which imbues the spring with its essential spring characteristics along the rotational axis. The spring is supported towards the second housing part in a region which is arranged in axial alignment with the stroke ring in the direction of the rotational axis, and thus presses the second housing part against the stroke ring.

9 Claims, 19 Drawing Sheets

(51) Int. Cl.

| | |
|---|---|
| ***F04C 15/00*** | (2006.01) |
| ***F04C 27/00*** | (2006.01) |
| ***F01C 19/00*** | (2006.01) |
| ***F01C 21/10*** | (2006.01) |
| ***F01M 1/02*** | (2006.01) |
| ***F04C 2/08*** | (2006.01) |
| *F04C 2/344* | (2006.01) |

(52) U.S. Cl.

CPC ..... *F01M 1/02* (2013.01); *F04C 2/08* (2013.01); *F04C 2/3445* (2013.01); *F04C 2/3446* (2013.01); *F04C 2/3448* (2013.01); *F04C 15/0023* (2013.01); *F04C 15/0034* (2013.01); *F01M 2001/023* (2013.01); *F01M 2001/0238* (2013.01); *F01M 2001/0292* (2013.01); *F04C 2/344* (2013.01); *F04C 2240/30* (2013.01)

(58) Field of Classification Search

CPC .... F04C 2/3446; F04C 2/3448; F01C 19/005; F01C 21/108; F01M 1/02; F01M 2001/023; F01M 2001/0238

USPC ..... 418/149, 259, 266–268, 133, 30, 135; 184/6.16–6.18

See application file for complete search history.

(56) References Cited

U.S. PATENT DOCUMENTS

| | | | | |
|---|---|---|---|---|
| 3,311,064 | A * | 3/1967 | Eichele ..... | F04C 15/0023 418/133 |
| 3,973,881 | A | 8/1976 | Melchinger | |
| 6,641,380 | B1 | 11/2003 | Nied-Menninger et al. | |
| 2011/0311387 | A1 | 12/2011 | Schultz | |
| 2015/0125332 | A1 | 5/2015 | Rosenkranz et al. | |

FOREIGN PATENT DOCUMENTS

| | | | |
|---|---|---|---|
| DE | 10117376 | A1 | 10/2001 |
| DE | 19952605 | A1 | 10/2001 |
| DE | 10 2011 104 324 | A1 | 12/2011 |
| EP | 0415089 | A2 | 3/1991 |
| EP | 1026401 | A2 | 8/2000 |
| WO | 2013185751 | A1 | 12/2013 |

OTHER PUBLICATIONS

English abstract of DE 10117376, EPO Online Services, http://worldwide.espacenet.com/, Accessed May 13, 2016, 1 page.

English abstract of EP 0415089, EPO Online Services, http://worldwide.espacenet.com/, Accessed May 13, 2016, 1 page.

* cited by examiner

PUMP COMPRISING A SPRING

This application claims the benefit of the earlier filing date of German patent application 10 2015 105 933.9, filed Apr. 17, 2015.

The invention relates to a pump, in particular a displacement pump, for a liquid such as for example oil. The pump can for example be embodied as a vane cell pump or a rotary vane pump, an internal or external toothed wheel pump, reciprocating piston valve pump or roller cell pump. The pump is in particular suitable for being incorporated into a vehicle, such as for example a motor vehicle, and/or for supplying a consumer in a motor vehicle. The consumer can for example be an internal combustion engine or a transmission, such as for example a steering gear or automatic transmission. A first aspect relates to supporting a spring which acts between an accommodating housing and a pump insert which is inserted into the accommodating housing. A second aspect relates to combining a seal and a spring which acts between the accommodating housing and the pump insert. A third aspect relates to sealing off pressure spaces of a multi-stroke pump with respect to each other. Each of the aspects mentioned can, but need not necessarily, be combined with one or more of the other aspects mentioned or developments of them.

WO 2013/185751 A1 discloses a so-called cartridge pump which comprises a pump assembly or pump insert which consists substantially of a rotor, a stroke ring, a side plate, a pressure plate, pressing pins and a spring element. The rotor is accommodated, such that it can be rotated, between the pressure plate and the side plate and is surrounded by the stroke ring, which is likewise arranged between the pressure plate and the side plate. The pressure plate, the side plate and the stroke ring are secured, rotationally and axially fixed with respect to each other, by a number of pressing pins which are pressed, axially fixed, into the pressure plate and penetrate through the side plate and the stroke ring. The spring element is fastened to the pressure plate on the end-facing side of the pressure plate which points away from the rotor. The pump insert is inserted into a cup-shaped housing, wherein the spring element is supported on the base or on an end-facing wall of the cup-shaped housing. The housing is sealed by a housing cover which holds the pump insert in its installed position. Two flexible tongues of the spring element are supported on a cold start plate which is in turn supported on the pressure plate. The pump comprises a seal which is arranged between the end-facing wall and the pressure plate and which seals off a first pressure space and a second pressure space with respect to each other, wherein the pressure spaces are arranged between the end-facing wall and the pressure plate. The seal is a part which is separate from the spring element.

EP 0 415 089 A2 describes an axial seal comprising a locking ring and a sealing ring which is integrally fastened to it. The locking ring consists of a thermoplastic comprising an extrusion-resistant core and a slightly flexible surface which, due to the compressed sealing ring and the oil pressure, is pressed against the wall of the gap which is to be sealed off. A pump insert which is arranged in a cup-shaped pump housing part comprises a pressure plate, wherein the axial seal is arranged between the pressure plate and an end-facing wall of the pump housing part. A valve spring which is separate from the axial seal acts between an end-facing wall of the pump housing part and the pressure plate. The valve spring is supported on the pressure plate via a valve. The valve is supported on the pressure plate centrically, i.e. in the region of a rotational axis of a rotor of the pump insert. EP 0 415 089 A2 shows embodiments comprising one or more axial seals, wherein the axial seal(s) seal off a region on the suction side from a region on the pressure side. The region on the suction side and the region on the pressure side are arranged between the end-facing wall and the pressure plate.

The first aspect is based on the object of preventing, as far as possible, a detrimental deformation in the pump cover and/or end-facing wall of the accommodating housing caused by the spring force. The second aspect is based on the object of facilitating the ability of the pump insert to be incorporated into the accommodating housing. The third aspect is based on the object of specifying a space-saving pump which can supply various fluid circuits with pressure fluid.

The invention proceeds from a pump, in particular a displacement pump, such as for example a vane cell pump or rotary vane pump or a toothed wheel pump or a reciprocating piston valve pump or a roller cell pump. The pump comprises: an accommodating housing which forms a cup-shaped accommodating space comprising an end-facing wall and a circumferential wall; and a pump insert which is arranged in or inserted into the accommodating space, in particular as a unit which can be handled separately from the accommodating housing. The pump insert can be supported or centred on the circumferential wall of the cup-shaped accommodating space or can form at least one circumferential sealing gap with the circumferential wall. The pump insert can therefore be guided by the circumferential wall.

The pump insert comprises a housing which encloses a pump space. A rotor can be arranged in the pump space, such that it can be rotated about a rotational axis relative to the housing. The pump can comprise the rotor and at least a first housing part, in particular a first housing cover, and a second housing part, in particular a second housing cover, between which the rotor is arranged such that it can be rotated about a rotational axis and relative to the first and second housing part. The rotor can be connected or able to be connected directly or indirectly to a pump shaft, in a way which transmits torque, such as for example via a shaft-hub connection. When the pump shaft is rotated relative to the first and second housing part, the rotor is rotated along with it. The rotor comprises cavities, in particular guides, such as for example slot-shaped cavities or guides, in which delivery elements such as for example vanes, sliders or rollers are accommodated such that they can be moved, in particular shifted, radially with respect to the rotational axis. The delivery elements are accommodated or mounted by the rotor such that they are rotated along with the rotor about its rotational axis. In particular, each of the delivery elements is mounted in its guide such that it can be shifted with one translational degree of freedom.

The pump shaft can extend through the housing and can be mounted on the housing such that it can be rotated about the rotational axis, such as for example with a first portion mounted on the first housing part and a second portion mounted on the second housing part. An outer structure for the shaft-hub connection can be formed between the first portion and the second portion of the pump shaft. The rotor and the pump shaft can be non-rotationally connected by means of a shaft-hub connection, for example a straight-toothed shaft-hub connection. The shaft-hub connection comprises an inner toothed gearing featuring a number of teeth, and an outer toothed gearing which features a number of teeth and engages with the inner toothed gearing.

A third housing part, namely a stroke ring, can be arranged between the first housing part and the second housing part. The stroke ring surrounds the rotor over its circumference. The stroke ring can be a part which is separate from the first and second housing part. Alternatively, the stroke ring can be a portion of the first housing part which is formed by the first housing part, or a portion of the second housing part which is formed by the second housing part. The first housing part or the second housing part or both can surround the rotor and in particular its delivery elements, such as for example annularly, if the stroke ring is part of the first or second housing part.

The first housing part, the second housing part and the stroke ring enclose and delineate a pump chamber in which the rotor and the delivery elements are arranged. At least one delivery chamber, such as for example a first delivery chamber and a second delivery chamber in the case of a twin-stroke pump, is/are formed radially between the stroke ring and the rotor which is trapped between the first and second housing part such that it can be rotated.

A delivery cell is respectively formed between adjacent delivery elements and is delineated circumferentially by an inner circumferential surface of the stroke ring and in the direction of the rotational axis by the first housing part on one side and by the second housing part on the other side and changes its volume as a function of the rotational position of the rotor about its rotational axis. The pump comprises a multitude of delivery elements and therefore a multitude, in particular an identical multitude, of delivery cells which are formed between the delivery elements.

The inner circumference of the stroke ring exhibits a contour along which the delivery elements slide when the rotor rotates. The contour is in particular embodied such that the delivery cells moving through the delivery chamber due to the rotation of the rotor initially increase in volume and then decrease in volume. In one complete revolution of the rotor, the delivery elements are moved away from the rotational axis and towards the rotational axis at least once. The pump can for example be embodied as a twin-stroke pump, i.e. can be embodied with a first delivery chamber and a second delivery chamber, through each of which the delivery elements and/or delivery cells pass once during one complete revolution. This means that in one complete revolution, the delivery elements are alternately moved away from the rotational axis twice and towards the rotational axis twice. During a rotation of the rotor, a delivery cell initially increases in volume and then decreases in volume.

The pump or pump insert can comprise at least one inlet channel, which ports into the region of the delivery chamber in which a delivery cell increases in volume, and at least one outlet channel which ports into the region of the delivery chamber in which said delivery cell decreases in volume. Due to the increase in the volume of the delivery cell, the at least one inlet channel acts as a suction channel. Due to the decrease in volume, the at least one outlet channel acts as a pressure channel. A single-stroke pump can for example comprise one inlet channel and one outlet channel. A twin-stroke pump can for example comprise a combined inlet channel for the first and second delivery chamber, a first outlet channel for the first delivery chamber and a separate second outlet channel for the second delivery chamber. In an alternative, the pump insert can comprise a first inlet channel for the first delivery chamber, a separate second inlet channel for the second delivery chamber, a first outlet channel for the first delivery chamber and a separate second outlet channel for the second delivery chamber or a combined outlet channel for the first and second delivery chamber. The fluid delivered via the first delivery chamber can for example be supplied to other consumers or the same consumers as the fluid delivered via the second delivery chamber. If different consumers are supplied, different pressure levels between the first outlet channel and the second outlet channel and/or between the first pressure space, into which the first outlet channel ports, and the second pressure space, into which the second outlet channel ports, can be created. The delivery elements and/or the rotor respectively form a sealing gap with the first housing part and the second housing part. The at least one inlet channel can be connected to and in particular in fluid communication with a fluid storage container, such as for example an oil container. The at least one suction channel can for example port into a suction space which can for example be formed between the accommodating housing and the pump insert, in particular between the circumferential wall of the accommodating housing and the pump insert, such as for example the stroke ring. The at least one outlet channel can be connected to at least one fluid consumer and for example be in fluid communication with a transmission.

The pump insert can comprise at least one positioning element which positions the second housing part with respect to its angular position about the rotational axis relative to the first housing part. The at least one positioning element can be formed by the first housing part, in particular integrally or monolithically. Alternatively, the at least one positioning element can be formed as a part which is separate from and anchored in the first housing part. The positioning element can for example be screwed or pressed into the first housing part, i.e. anchored in a positive fit and/or force fit. Alternatively or additionally, the at least one positioning element can be anchored in a material fit, such as for example glued, soldered or welded, in the first housing part. The first housing part can comprise one bore for each positioning element, wherein one end of the positioning element is inserted into the bore and thus anchored in the first housing part. Two, three, four or more positioning elements can for example be provided.

The at least one positioning element can in particular be pin-shaped or cylindrical. The end of the positioning element which lies opposite the anchored end can for example exhibit the same outer diameter as the anchored end.

The second housing part and in particular also the stroke ring can be mounted on the at least one positioning element, secured against rotating about the rotational axis. The at least one positioning element can extend through a cavity in the second housing part, such as for example a bore or transit bore, one of which is provided for each positioning element. The at least one positioning element can for example extend through a cavity in the stroke ring which can for example be embodied as a bore, an elongated hole or the like.

The end of the at least one positioning element which lies opposite the end anchored in the first housing part can in particular protrude out of the second housing part and in particular from the end-facing side of the second housing part which lies opposite the end-facing side pointing towards the rotor, or which points towards the end-facing wall of the accommodating housing.

The pump or pump insert can comprise a spring which is for example supported on the second housing part and on the base or end-facing wall of the accommodating housing. As mentioned, the accommodating housing can for example be cup-shaped. The circumferential wall of the accommodating housing can extend around the rotational axis of the rotor. The end-facing wall is arranged on the end-facing side of the circumferential wall, such that the accommodating housing is cup-shaped. The spring, which is tensed between the end-facing wall and the pump insert, seeks to press the pump insert, in particular the second housing part, away from the end-facing wall of the accommodating housing.

The pump insert is prevented from falling out of the accommodating housing by for example a cover or an axial securing element, wherein the spring which is tensed when the pump insert is inserted presses the pump insert, in particular the first housing part, against the axial securing element or the cover, wherein the axial securing element or the cover prevents the spring from being relaxed. The axial securing element can for example be annular and inserted into an annular groove which is formed on the preferably cylindrical inner circumference of the accommodating housing. The axial securing element can be formed by a cover which at least partially or completely seals the opening.

The spring which is tensed between the pump insert and the end-facing wall exerts a force on the second housing part, wherein the force points away from the end-facing wall and acts in particular along, i.e. in the direction of, the rotational axis of the rotor, and the second housing part is thus pressed against the stroke ring, wherein the stroke ring is pressed against the first housing part. The counter bearing for this is formed by the cover or the axial securing element. The spring force axially seals off the stroke ring in relation to the first and second housing part, thus enabling pressure to be built up in the delivery chamber or delivery chambers when the pump is started up.

The spring can in particular be captively fastened to the pump insert, in particular to the at least one positioning element or the second housing part. The spring can for example be connected to the positioning element or the second housing part in a positive fit, in particular snapped onto it, or in a force fit, such that the spring is held on the at least one positioning element or the second housing part and preferably is or can be supported on the second housing part. Preferably, the spring is fastened to the at least one positioning element or the second housing part, secured against rotating about the rotational axis, in particular in a positive fit and/or force fit. The spring can comprise or form at least one fastening element, in particular on or in the region of a supporting portion via which the spring is supported on the second housing part or on a part which is indirectly or directly supported on the second housing part. The at least one fastening element can for example serve as the supporting portion, or one fastening element can be provided for each supporting portion. By means of the fastening element, the spring can be fastened or able to be fastened to the at least one positioning element or the second housing part. The fastening element, which is for example embodied for a positive-fit connection to the positioning element assigned to it, can be snapped onto the positioning element.

The at least one positioning element can comprise a cavity, such as for example an annular groove over its circumference, with which the at least one fastening element of the spring engages. Such an annular groove can be embodied as a clearance groove. The at least one fastening element can for example be embodied in the shape of a securing disc or retaining ring, similar to securing discs for shafts in accordance with DIN 6799 or securing rings for shafts in accordance with DIN 471, in particular with the difference that they can be formed by the spring, i.e. integrally formed on the supporting portion.

In alternative embodiments, the securing element—in particular, the securing disc embodied for example in accordance with DIN 6799 or the retaining ring embodied in accordance with DIN 471—can be an actual disc or ring, i.e. not integrally formed on the spring, and can for example merely serve to ensure that the second housing part cannot be axially removed from the positioning element. In this embodiment, the spring can be fastened to the second housing part or to the securing element or trapped between the securing element and the second housing part, wherein the fastening element of the spring can be fitted onto the positioning element. In alternative embodiments, the positioning element can for example be embodied with a tip, wherein the second housing part is trapped between the first housing part and the tip, such that the second housing part is prevented from being removable from the first housing part and/or the positioning element. In these embodiments, the spring can be fastened to the second housing part or to the tip or trapped between the tip and the second housing part, wherein the fastening element of the spring can be fitted onto the positioning element.

In other embodiments, the cavity can be an annular groove which extends over the circumference of the cylindrical or pin-shaped positioning element and exhibits a width, extending along the longitudinal axis of the positioning element, which is dimensioned such that the fastening element of the spring is accommodated in the annular groove with a clearance along the longitudinal axis. It is thus possible to ensure that the supporting portion or the fastening element of the spring is supported on the second housing part and not on a groove flank of the annular groove.

In embodiments in which the spring is fastened to the second housing part, an inner circumferential surface or an outer circumferential surface of the second housing part can comprise a groove which at least partially or completely encircles the rotational axis of the rotor and is open towards the inside or outside, wherein the spring, i.e. one or more portions of the spring, is/are fastened to the second housing part in the groove, in particular enclosed by the groove. The groove width is slightly larger than the thickness of the portions of the spring which are arranged in the groove for the purpose of fastening. The spring can for example be elastically compressed laterally, in order to be inserted into the groove, wherein the spring is positioned in the immediate vicinity of the groove and then released. Due to the spring's elasticity, it resumes its original shape, whereby the spring and/or portions of it latch into the groove and captively fasten the spring to the second housing part. When it is relaxed, the spring can for example exhibit an oval shape or comprise projections which form said portions, wherein the circumferential groove or annular groove extends circularly around the rotational axis.

The pump can comprise a pump shaft which is non-rotationally connected to the rotor and can be rotated about the rotational axis. The pump shaft can be mounted such that it can be rotated in at least the first housing part. The pump shaft can additionally be mounted such that it can be rotated in the second housing part, in particular in a blind cavity or a continuous cavity, in particular a bore, through the second housing part. The blind cavity has the advantage that the pump chamber is sealed off with respect to the end-facing side of the second housing part which points away from the pump chamber. The continuous cavity has the advantage that it is easy to produce and ensures a greater level of stability. The bearing(s) can be slide bearings or roll bearings.

The pump shaft can comprise a structure, in particular an outer toothed gearing, for a shaft-hub connection to the rotor. The diameter of the structure can be larger than the inner diameter of the first housing part and/or the second housing part or the bearings. The structure is therefore trapped between the first housing part and the second housing part along, i.e. in the direction of, the rotational axis.

This means that the shaft cannot be drawn out of the completely incorporated pump insert.

The pump insert, which can be handled as a unit, can in particular be substantially formed by the first housing part, the second housing part, the stroke ring, the rotor, the delivery elements, the positioning elements, the spring and the pump shaft. Since the spring is fastened to the at least one positioning element, it is possible to prevent the pump insert from falling apart. The fastening elements of the spring and/or the securing elements which are separate from the spring axially secure the shaft, such that the pump insert does not fall apart.

Since the pump insert is easy to handle, it can be accommodated and/or inserted into the accommodating housing—which can for example be formed by a transmission housing for a motor vehicle—for example via an opening in the accommodating housing which lies opposite the end-facing wall.

In other embodiments, a (second) seal—in particular, a sealing ring—which can be arranged between the second housing part and the accommodating housing, in particular the circumferential wall, seals off a pressure space, which is formed substantially between the end-facing wall and the second housing part, in relation to a suction space which is formed between the circumferential wall and the first housing part and/or the stroke ring. The pressure space can for example be connected to the at least one delivery chamber by means of the at least one outlet channel.

A (first) seal, in particular a sealing ring, can be arranged between the first housing part and the accommodating housing, in particular the circumferential wall, wherein the suction space is arranged between the first and second seal. The first seal can seal off the suction space with respect to the outside or with respect to the opening in the accommodating housing. Since the at least one pressure space is arranged between the end-facing wall and the second housing part, the second housing part acts like a piston which, when the pressure is increased in the pressure space, increases the force on the axial securing element or the cover along or in the direction of the rotational axis and therefore also presses the parts of the pump insert—in particular the first housing part, the second housing part and the stroke ring—against each other, forming a seal, namely with a force which increases as the delivery pressure increases, in addition to the force of the biased spring.

In accordance with the first aspect, the spring which is elastically arranged, in particular tensed, between the accommodating housing and the second housing part is supported towards the second housing part substantially in a region which is arranged in axial alignment with the stroke ring in the direction of the rotational axis of the rotor, and thus—i.e. by being supported in alignment with the stroke ring—presses the second housing part against the stroke ring, wherein "in alignment" means "in an imaginary axial elongation of the wall of the stroke ring along or in the direction of the rotational axis". In WO 2013/185751 A1, the two flexible tongues of the spring element are supported on a cold start plate and in a region which is outside the axial alignment with the stroke ring, i.e. within the inner contour of the stroke ring. Due to the radial distance between the region on which the spring is supported and the stroke ring, a moment is created which causes a deformation in the cover, albeit only slight, which however increases the degree of friction between the rotor and the cover or alternatively means the sealing gap has to be formed so as to be relatively large, thus decreasing the effectiveness of the pump. In EP 0 415 089 A2, the valve spring is supported on the pressure plate via the valve, wherein the region is again within the inner dimensions of the stroke ring, which can again cause small deformations in the cover. Supporting the spring in accordance with the first aspect prevents such deformations, thus increasing the effectiveness of the pump.

The spring can in particular comprise a spring structure made of metal, in particular steel or spring steel, wherein the spring structure made of metal imbues the spring with its essential spring characteristics along or in the direction of the rotational axis. This is to be understood to mean that the spring can for example be coated in another material, or that another material can be injection-moulded around the spring, wherein said material likewise exhibits spring characteristics, even if they are negligible as compared to the spring structure made of metal.

The spring can be indirectly or directly supported on the second housing part. An intermediate part can for example be arranged between the second housing part and the spring, wherein the spring is supported on the intermediate part. In particular, the intermediate part can be supported on the second housing part, preferably again in a region which is arranged in axial alignment with the stroke ring in the direction of the rotational axis.

The intermediate part can for example comprise or be a so-called cold start plate or a plate-shaped structure, such as for example a perforated (metal) sheet or a cribriform structure. The intermediate part can for example be trapped or arranged between the spring and the second housing part and/or held on or fastened to the at least one positioning element, and for example comprise a cavity or bore for each positioning element it is fastened to, through which the relevant positioning element extends. The intermediate part can comprise at least one region featuring the cribriform structure, or at least one perforated region, such as for example one, two or more such regions. The intermediate part is in particular arranged such that the liquid delivered from the at least one delivery chamber flows through said at least one region. The flow resistance, albeit for example a low flow resistance, caused by said at least one region when the liquid flows through it increases the pressure on the incident flow side, i.e. on the side of the intermediate part onto which the liquid flows from the at least one delivery chamber.

The pump insert, in particular the second housing part, comprises at least one connecting channel on the incident flow side of the intermediate part, wherein the connecting channel supplies the sub-vane chambers, i.e. the chambers which are formed in the slots in which the vanes are guided and which extend radially between one end of the respective vane and the base of the respective slot, with the liquid delivered from the at least one delivery chamber. The dynamic pressure generated by the region of the intermediate part through which the liquid flows causes the vanes to extend more quickly during a cold start and therefore generally causes the pump to build up pressure more quickly. As an alternative to or in addition to the cribriform or perforated structure, the intermediate part and/or the spring on which the intermediate part can be supported, for example flexibly, can be configured to be flexible enough that the intermediate part is at least partially raised off the second housing part when a pressure limit is reached, thus enabling liquid to flow from the delivery chamber through a gap which is thus formed between the intermediate part and the second housing part.

The spring, in particular the end of the spring which points towards the accommodating housing and/or the end-facing wall, can for example be supported on the accommodating housing, in particular the end-facing wall, substantially in a region which is arranged in axial alignment with the stroke ring in the direction of the rotational axis. One advantage of this is that the spring force can be prevented from deforming the end-facing wall. Another advantage is that the cross-section which the spring surrounds, in particular annularly, exhibits a relatively large diameter, in particular at least approximately the inner diameter or smallest inner diameter of the stroke ring. This advantageously means that the cross-section surrounded by the spring is relatively large and therefore provides the option of arranging a seal, in particular an axial seal, which is in particular annular, between the second housing part and the end-facing wall of the accommodating housing, forming a seal, in order for example to seal off a second pressure space with respect to a first pressure space. Accordingly, a sealing element which surrounds the pressure space, in particular annularly, can be arranged between the second housing part and the end-facing wall of the accommodating housing. The spring can in particular be annular and at least partially surround a pressure space, in particular a first pressure space, which is connected to the delivery chamber, in particular the first delivery chamber, via the outlet channel formed by the second housing part, in particular the first outlet channel. The spring can in particular be arranged in the first pressure space.

The seal, which is also referred to here as a sealing element, can in particular surround the second pressure space annularly, wherein the first pressure space which is formed between the end-facing wall of the accommodating housing and the second housing part is sealed off with respect to the second pressure space by means of the sealing element. As already mentioned, the first pressure space can be connected, via a first supply branch, to different fluid consumers than the second pressure space which is connected to fluid consumers via a second supply branch which is separate from the first supply branch. Alternatively, it is possible to supply one or more combined fluid consumers via separate supply branches, i.e. the first supply branch and the second supply branch, with fluid from the first pressure space and the second pressure space.

The spring which is arranged between the end-facing wall and the second housing part can for example be a corrugated annular spring, a multi-corrugated spring disc, a tube spring or bow spring, a grooved annular spring, a (metal) C-ring or a (metal) O-ring.

A multi-corrugated spring disc can comprise or consist of a spring structure made of metal, in particular steel, wherein the spring structure is formed from a flat or rounded material which forms a ring, in particular a closed ring. The spring, at least when it is not exposed to a load, is corrugated over the circumferential of the ring, i.e. embodied in a corrugated shape or embodied with a number of corrugations, in particular a number of corrugation peaks and troughs. The corrugation height extends along or in the direction of the rotational axis or substantially perpendicular or normal to the plane which is spanned by the annular spring structure. The multi-corrugated spring has the advantage that it can be inserted in a highly space-saving way.

A corrugated annular spring can comprise or consist of a spring structure which is formed from a flat or rounded material and wound helically around a longitudinal axis of the spring in a circumferential direction, wherein the spring structure is corrugated in the circumferential direction or comprises a number of corrugations, i.e. a number of corrugation peaks and troughs. The spring structure can be partially, completely or repeatedly wound around the longitudinal axis of the spring, in particular corrugated approximately helically. The corrugation peaks and troughs of adjacent windings can abut each other or be fastened to each other. This means that the corrugation peak of one winding abuts the corrugation trough of the next winding. The spring structure can comprise an initial winding and/or a final winding, wherein the initial winding and/or final winding extend substantially level around the longitudinal axis of the spring. The initial winding and/or final winding of the spring can be supported on the end-facing wall and/or indirectly or directly on the second housing part. The initial winding and final winding improve how the spring abuts, i.e. cause the spring force to be distributed over a greater area on the parts on which the spring is supported. The longitudinal axis of the spring is parallel to or lies on the rotational axis. The initial winding can for example comprise the fastening element for fastening to the positioning element.

A (metal) C-ring or a (metal) O-ring is annular. The spring structure extends, at least in portions, over the circumference of the longitudinal axis of the spring. The longitudinal axis of the spring is perpendicular or normal to the surface which the ring spans. The longitudinal axis of the spring is substantially parallel to or lies on the rotational axis of the rotor. The ring can be level or substantially not corrugated over its circumference. In the case of a (metal) C-ring, the spring structure is C-shaped, i.e. exhibits an open contour, in its cross-section transverse to the circumferential direction; in the case of a (metal) O-ring, it is O-shaped, i.e. exhibits a closed contour. A fastening element for fastening to the positioning element can be respectively formed between adjacent portions which comprise a C-ring-shaped or O-ring-shaped spring structure. The springs mentioned here can comprise a number of fastening elements for a number of positioning elements.

In a second aspect of the invention, an annular sealing element (seal or axial seal) is arranged between the end-facing wall and the second housing part, in particular the sealing element which has been described in general terms and/or with respect to the first aspect, and which encloses a pressure space formed between the end-facing wall and the second housing part, in particular the second pressure space, wherein the pressure space is connected via an outlet channel to a delivery chamber formed between the rotor and the stroke ring. The spring comprises a spring structure which is made of metal, in particular spring steel, and which imbues the spring with its essential spring characteristics, wherein the annular sealing element is fastened, in particular captively, to the spring structure. The spring and the sealing element can therefore form a unit or integral unit which can be handled as a unit. When fastening the spring to the second housing part or the at least one positioning element, the sealing element can for example likewise be arranged on the second housing part at the location provided for the sealing element. The advantage of this is that the spring and the sealing element can be fastened to the pump insert in one procedural step. It also advantageously means that the sealing element is fixed and cannot slip or fall out while the pump insert is being inserted into the accommodating housing. This facilitates incorporating the pump insert into the accommodating housing. The sealing element can be fastened to the spring element, for example by injection-moulding the sealing element around the spring or spring structure or integrally moulding the sealing element onto the spring or spring structure. Alternatively, the seal which is referred to as a sealing element can be fastened to the spring structure in a positive fit, such as for example by being fitted onto it, or in a force fit, such as for example by being clamped onto it.

The spring structure can for example comprise an additional annular portion which is part of the sealing element and coated in a sealing material, such as for example a polymer or elastomer, or around which a sealing material such as for example a polymer or elastomer is injection-moulded. The additional annular portion acts as a supporting structure which counteracts any extrusion or gap extrusion of the sealing material of the sealing element due to the pressure difference between the first pressure space and the second pressure space.

The spring structure can comprise another annular portion which is likewise coated in the sealing material or around which the sealing material is injection-moulded. This other additional annular portion can annularly surround the rotational axis of the rotor, in particular the pump shaft, when the latter extends through the second housing part in order to seal off the first pressure space and/or the second pressure space in relation to the pump shaft.

The seal or sealing element which surrounds the second pressure space is preferably arranged eccentrically with respect to the rotational axis of the rotor, in particular in a region between the annular spring, which at least partially surrounds the first pressure space, and the pump shaft or in a region which is arranged in axial alignment with the pump shaft in the direction of the rotational axis.

In a third aspect, a first pressure space and a second pressure space are formed between the end-facing wall and the second housing part, as has already been described further above. An annular sealing element such as has already been described is arranged between the end-facing wall and the second housing part and encloses the second pressure space and seals it off in relation to the first pressure space. The first pressure space is connected via a first outlet channel to a first delivery chamber which is formed between the rotor and the stroke ring, and the second pressure space is connected via a second outlet channel to a second delivery chamber which is formed between the rotor and the stroke ring. As described above, this enables different or combined consumers to be supplied with fluid via separate supply branches, wherein different pressures can be formed in the first and second pressure spaces.

Figure 2:
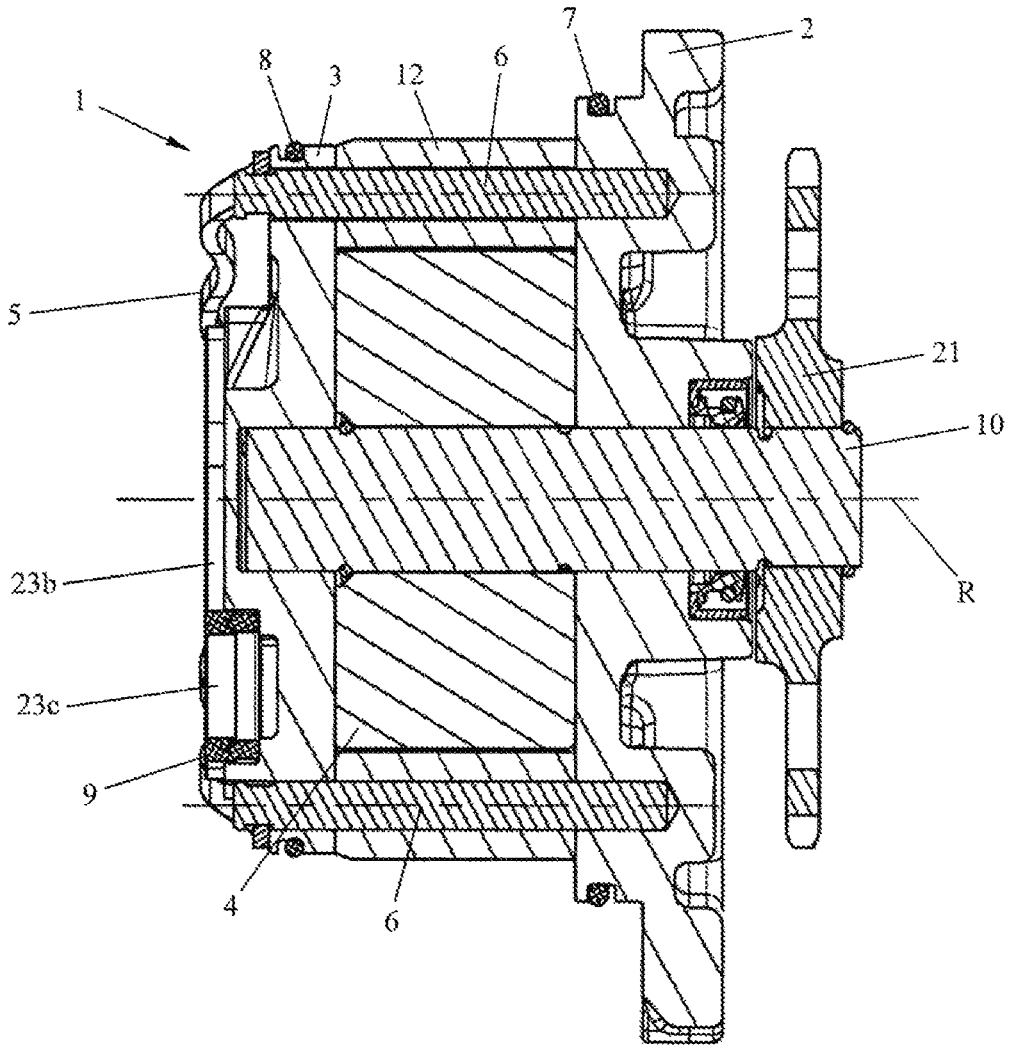
Figure 3:
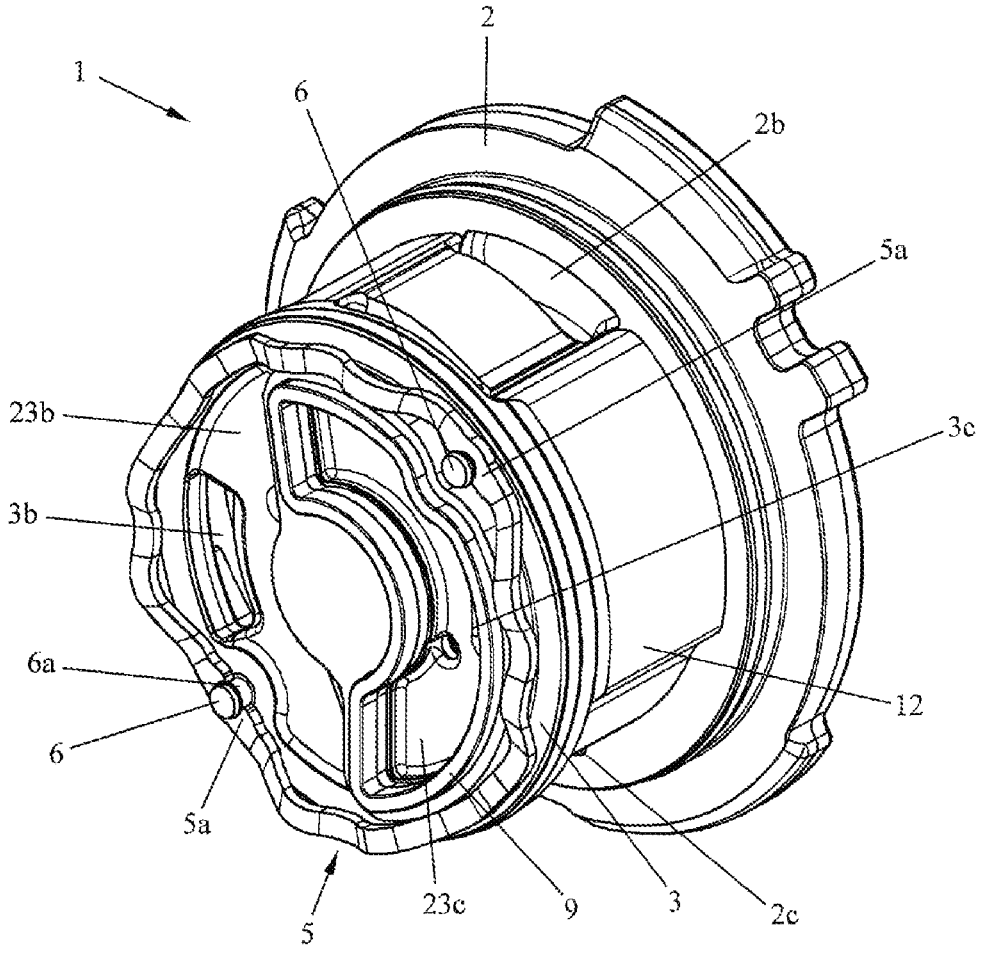
Figure 4:
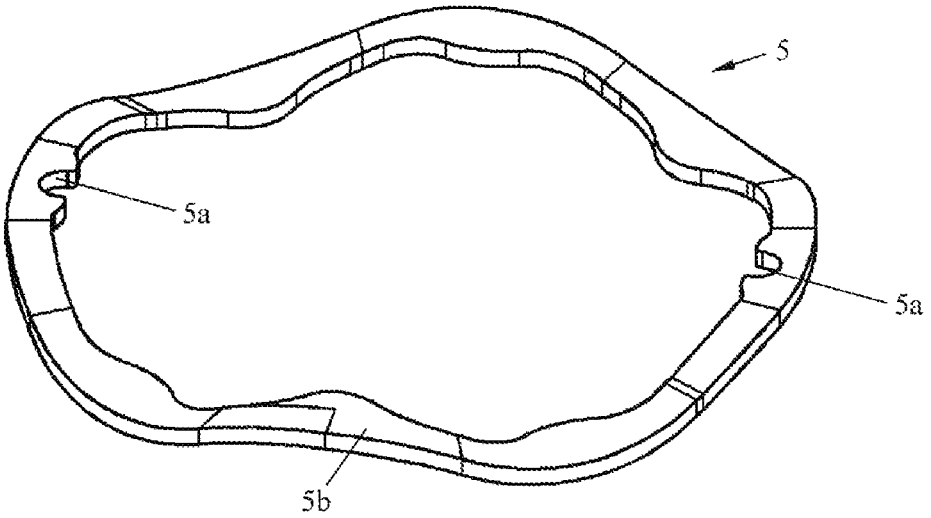
Figure 5:
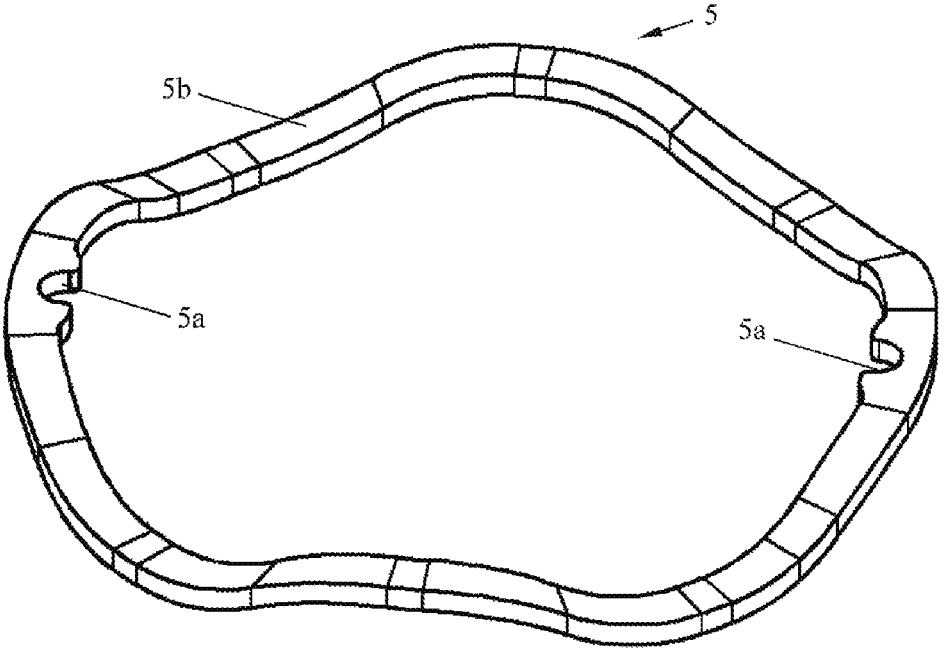
Figure 6:
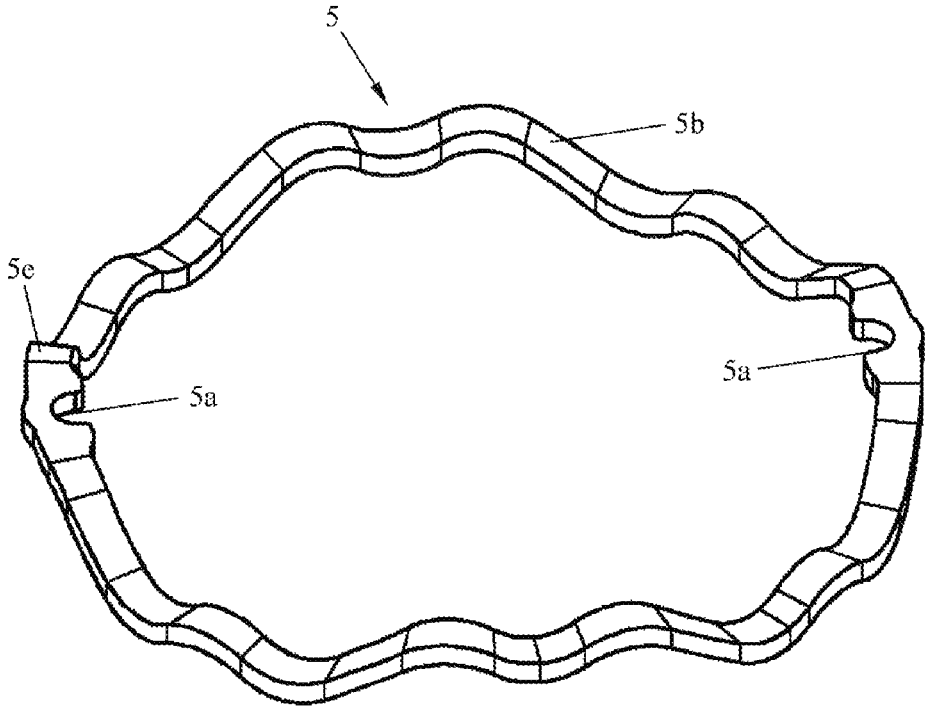
Figure 7:
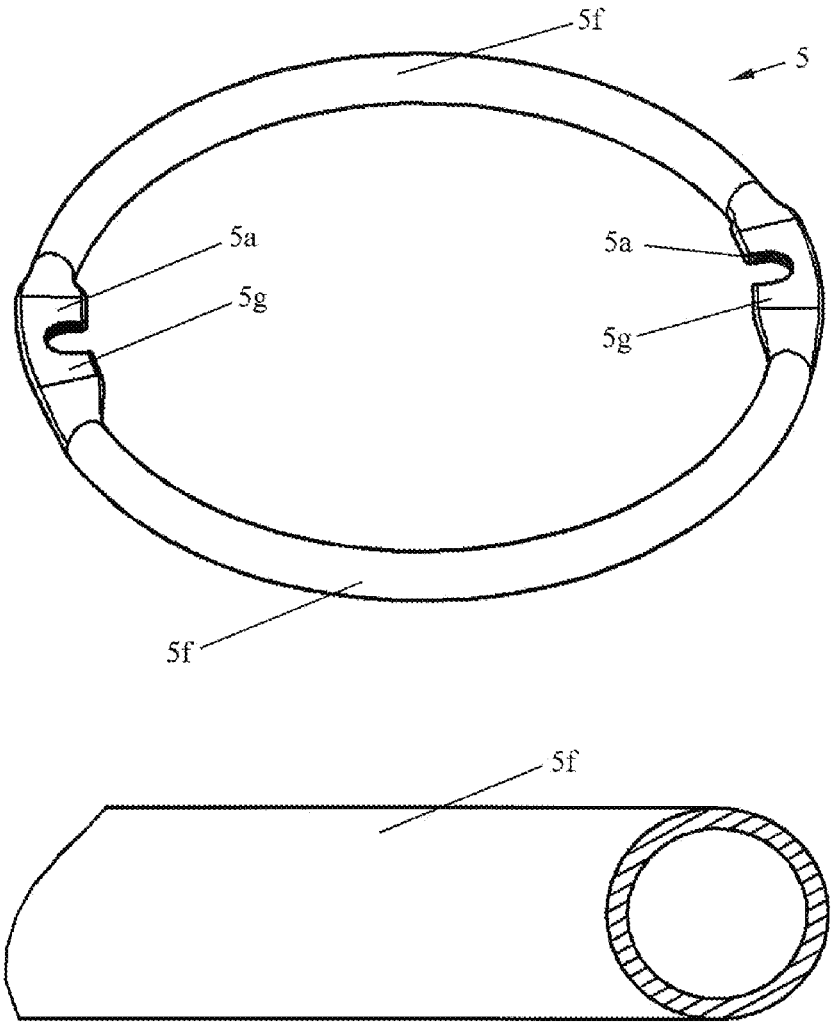
Figure 8:
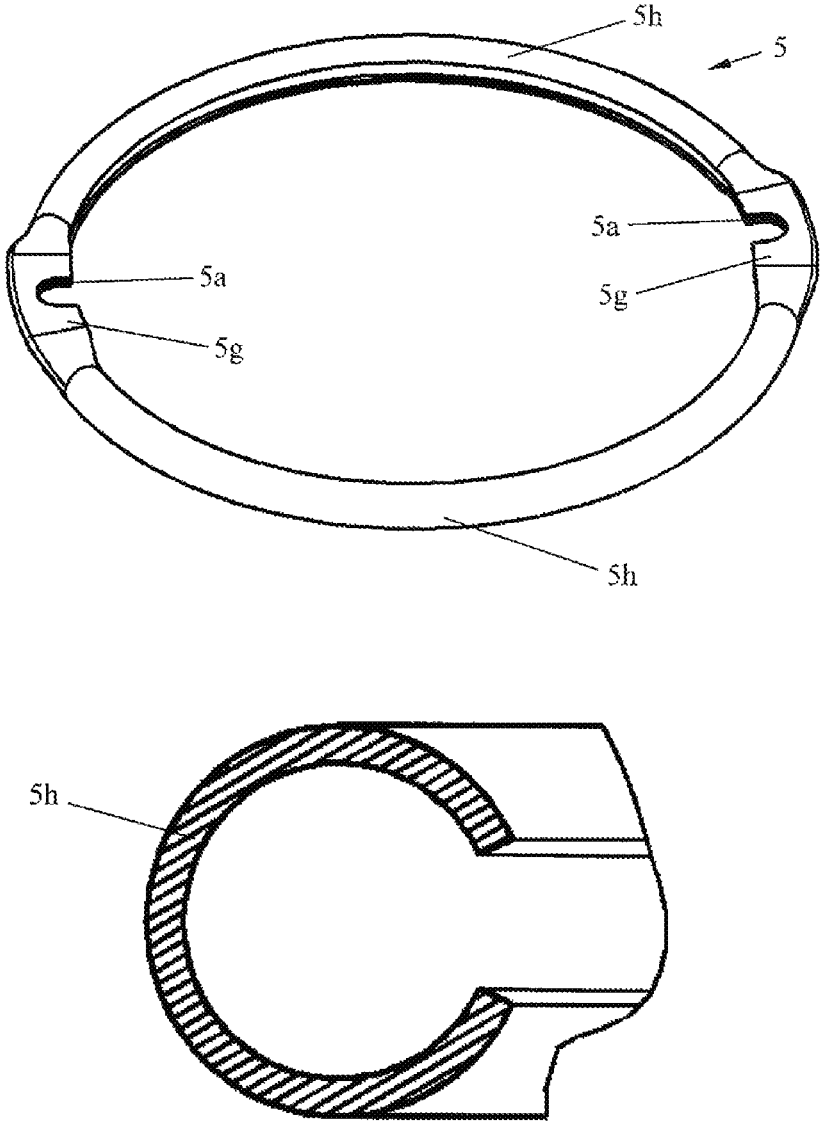
Figure 9:
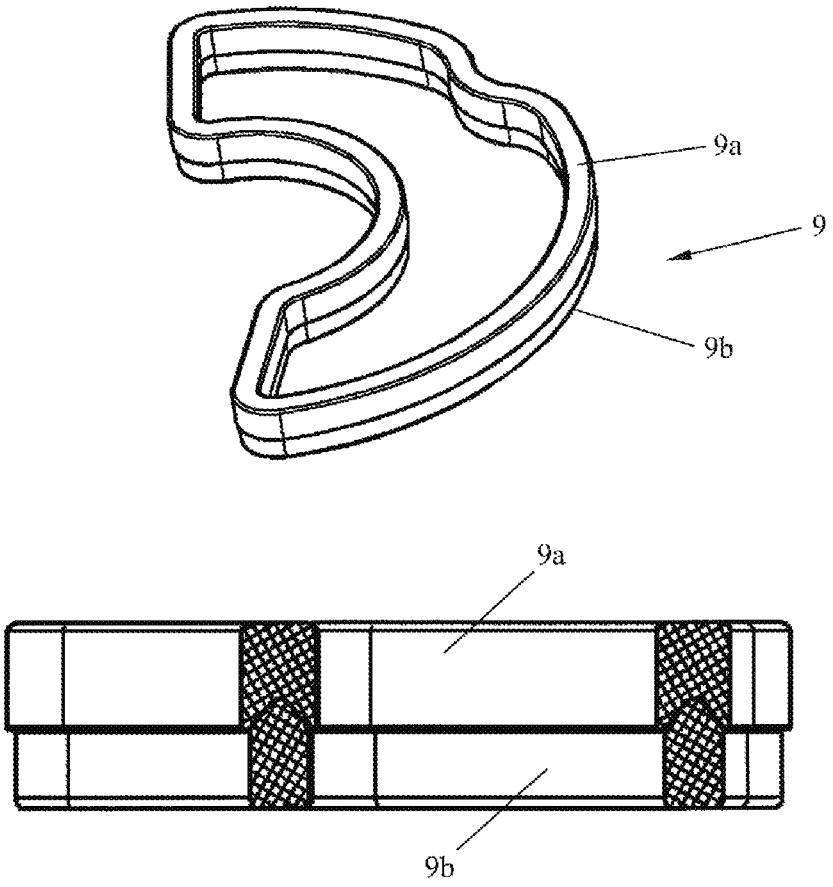
Figure 10:
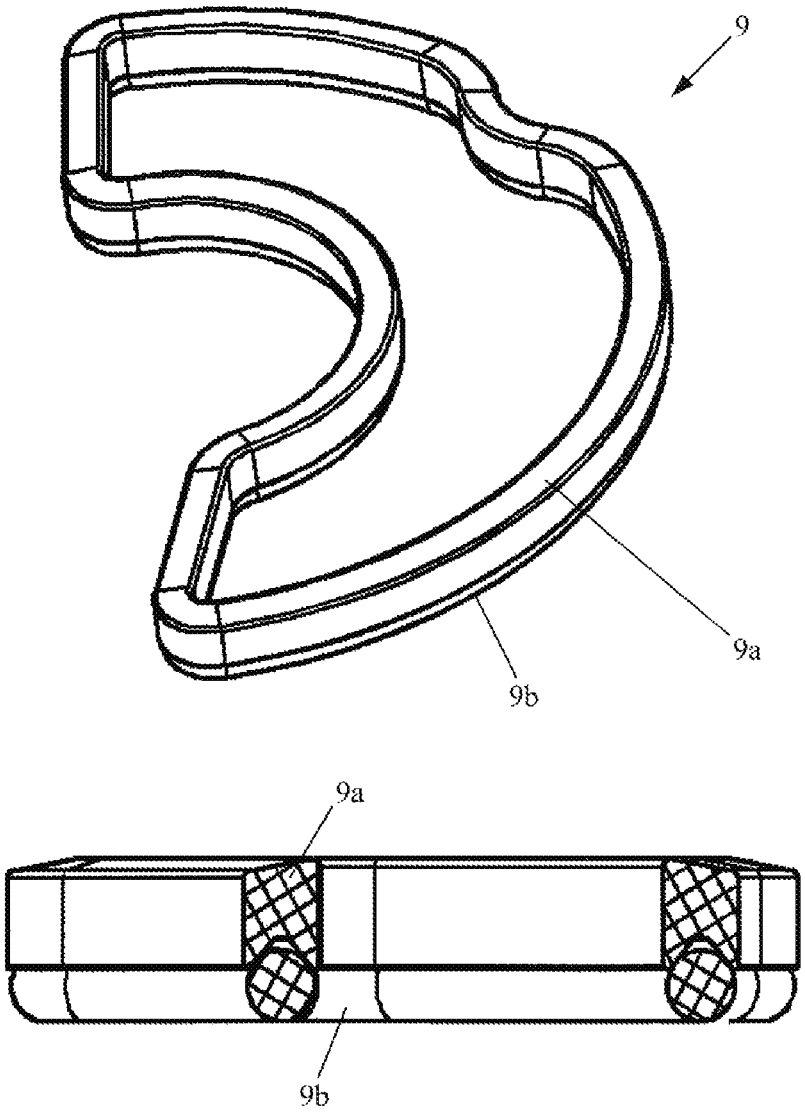
Figure 11:
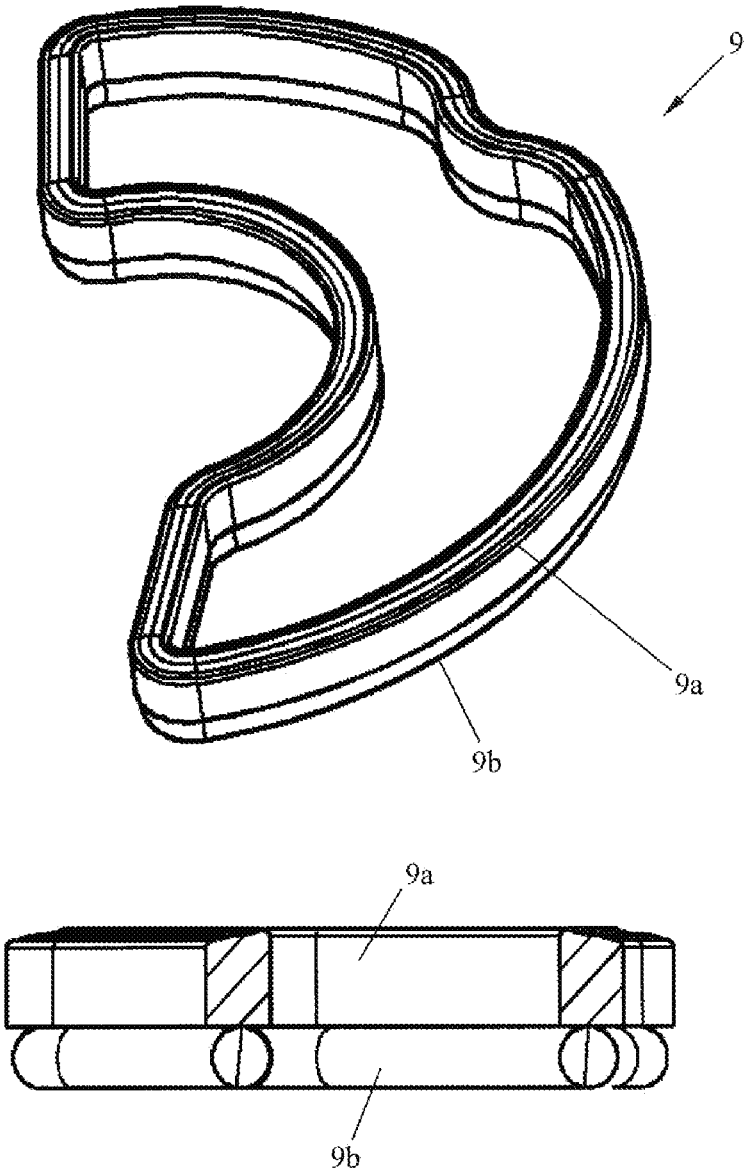
Figure 12:
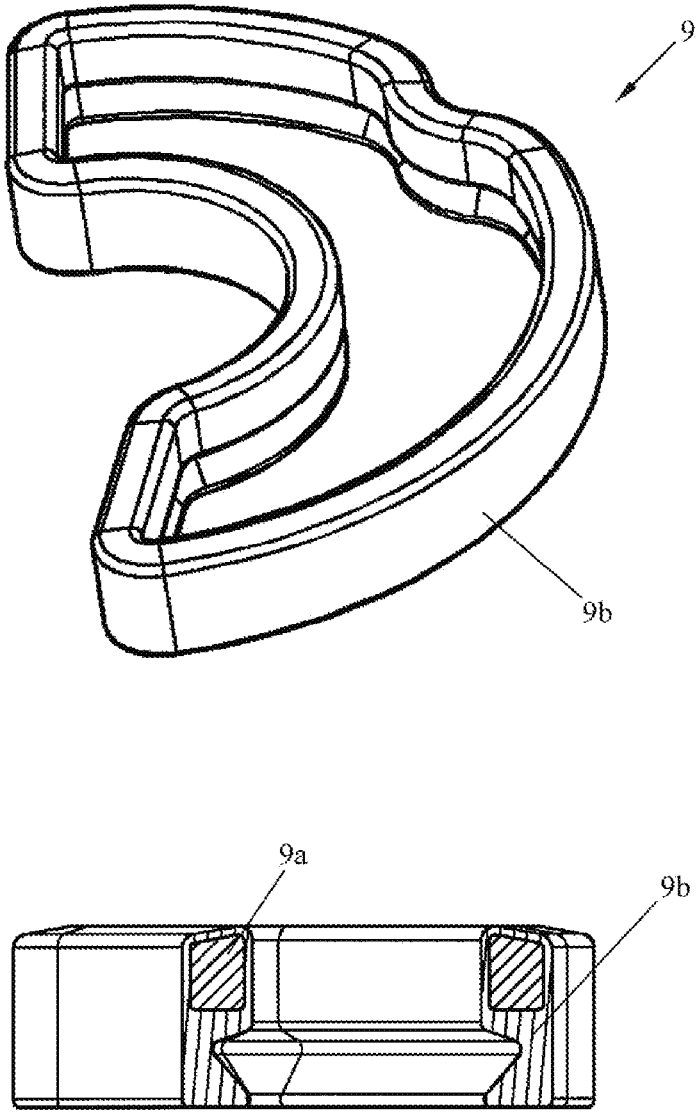
Figure 13:
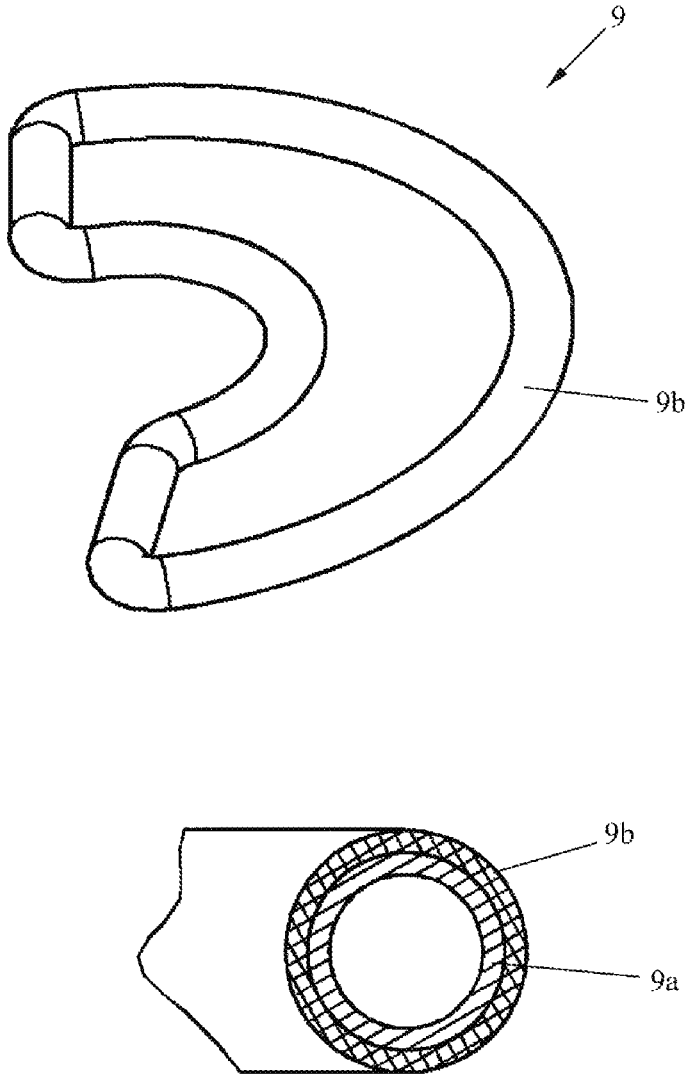
Figure 14:
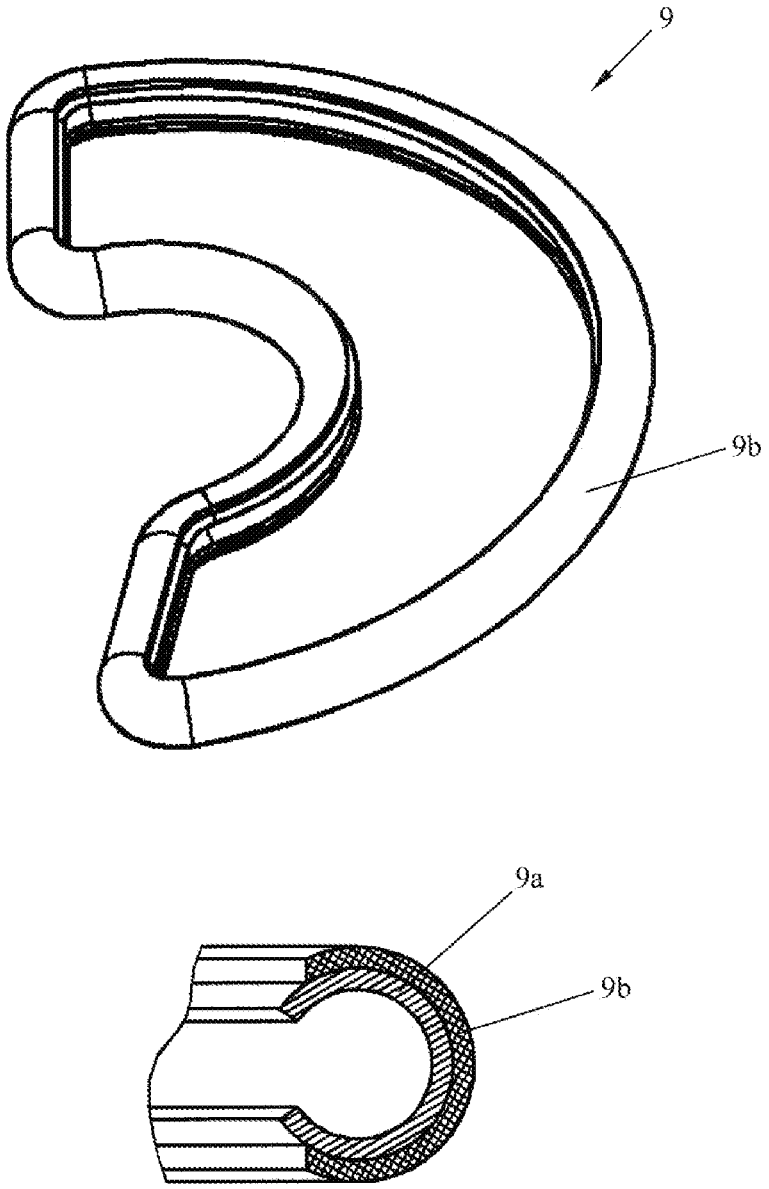
Figure 15:
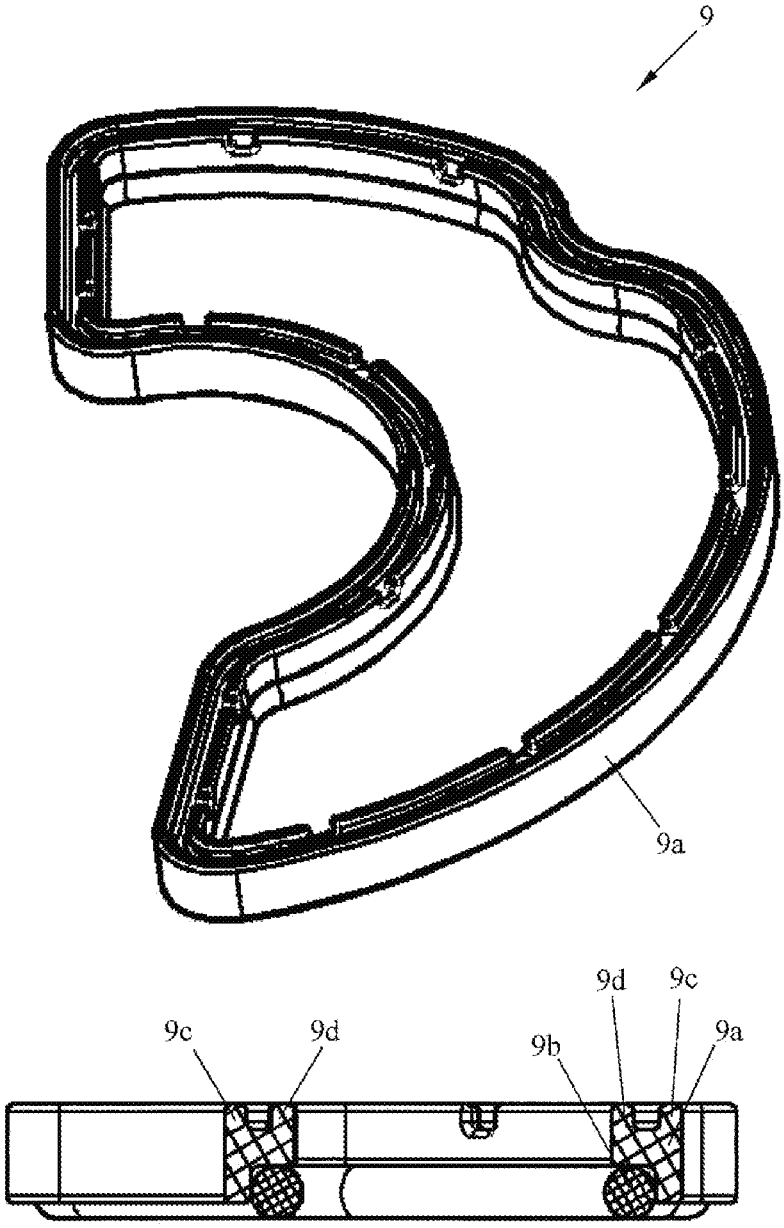
Figure 16:
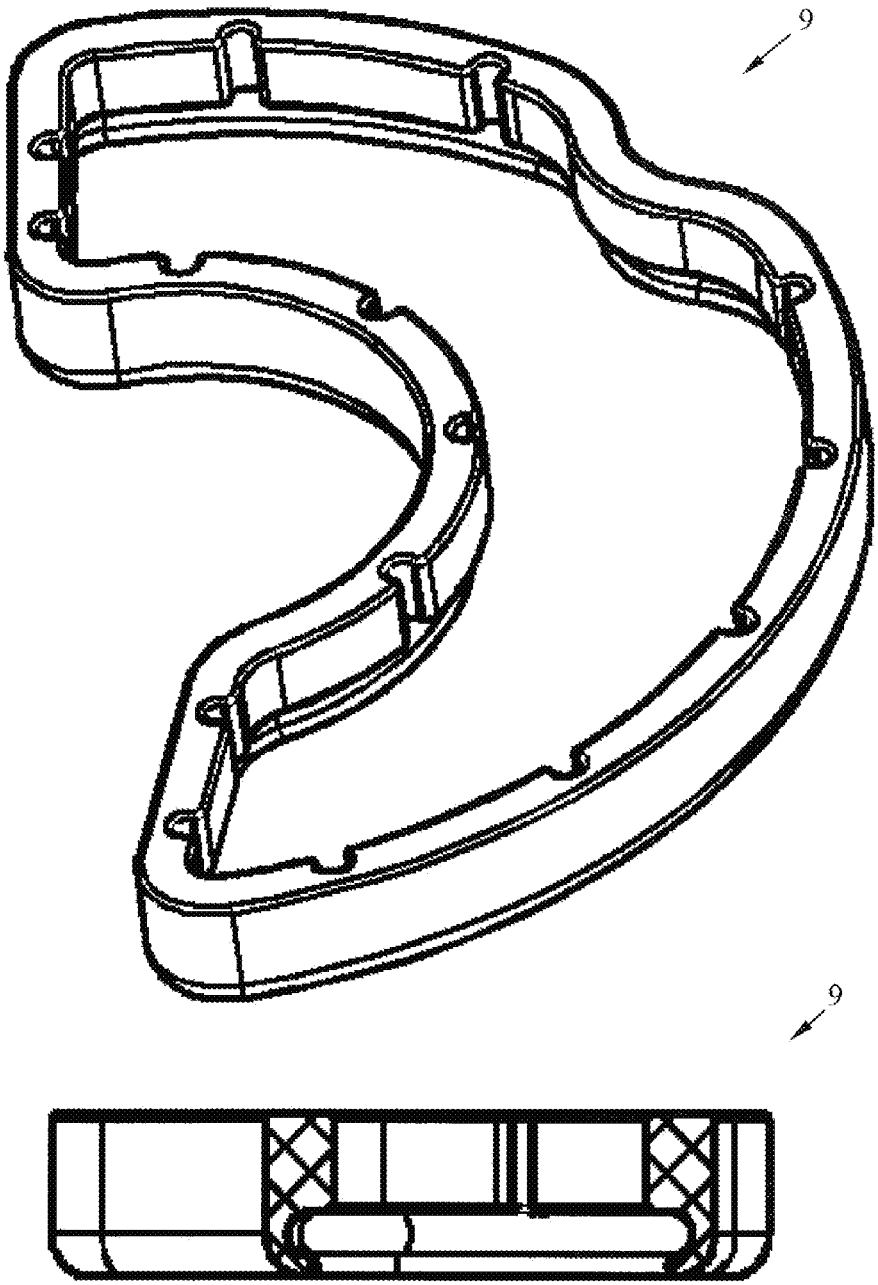
Figure 17:
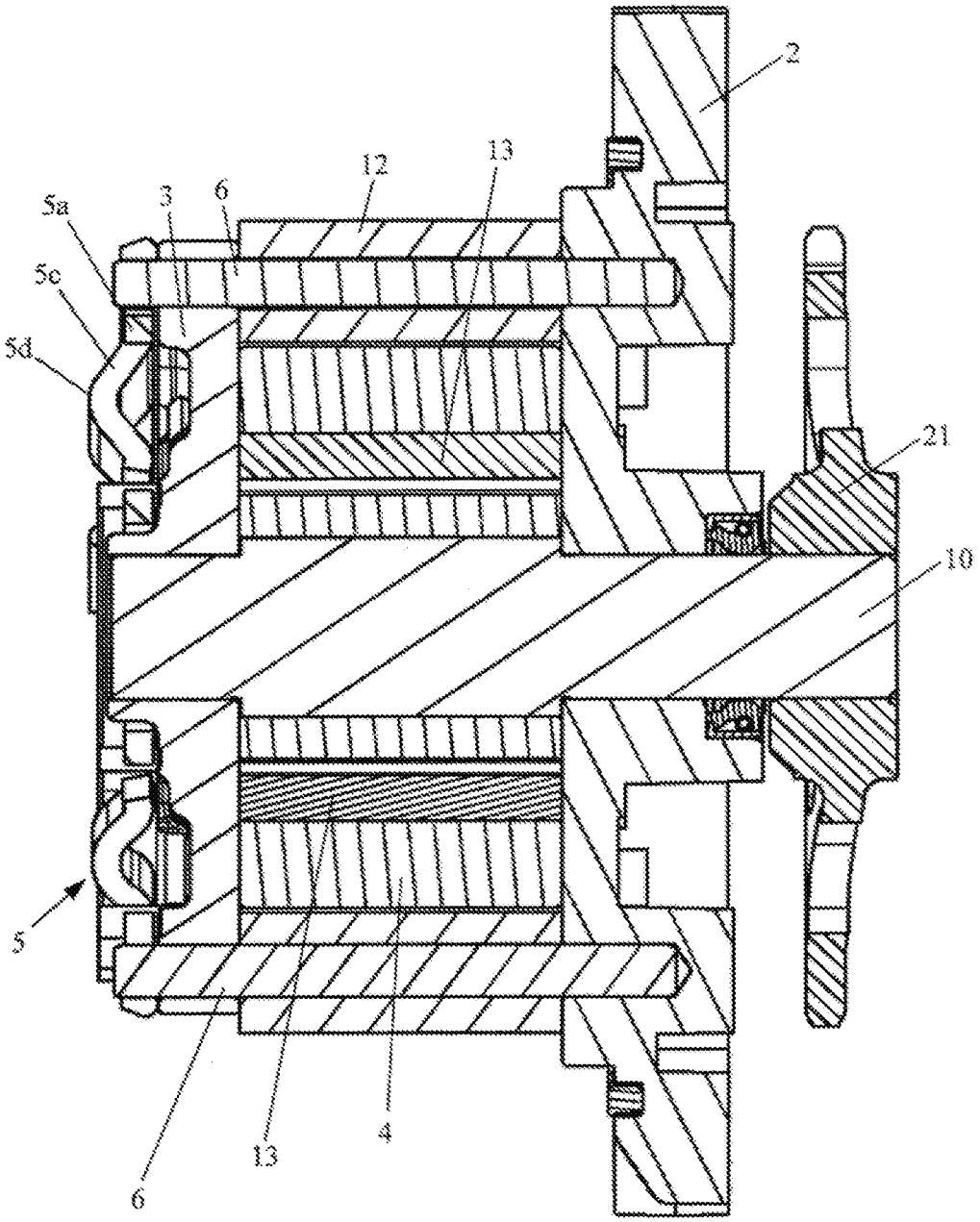
Figure 18:
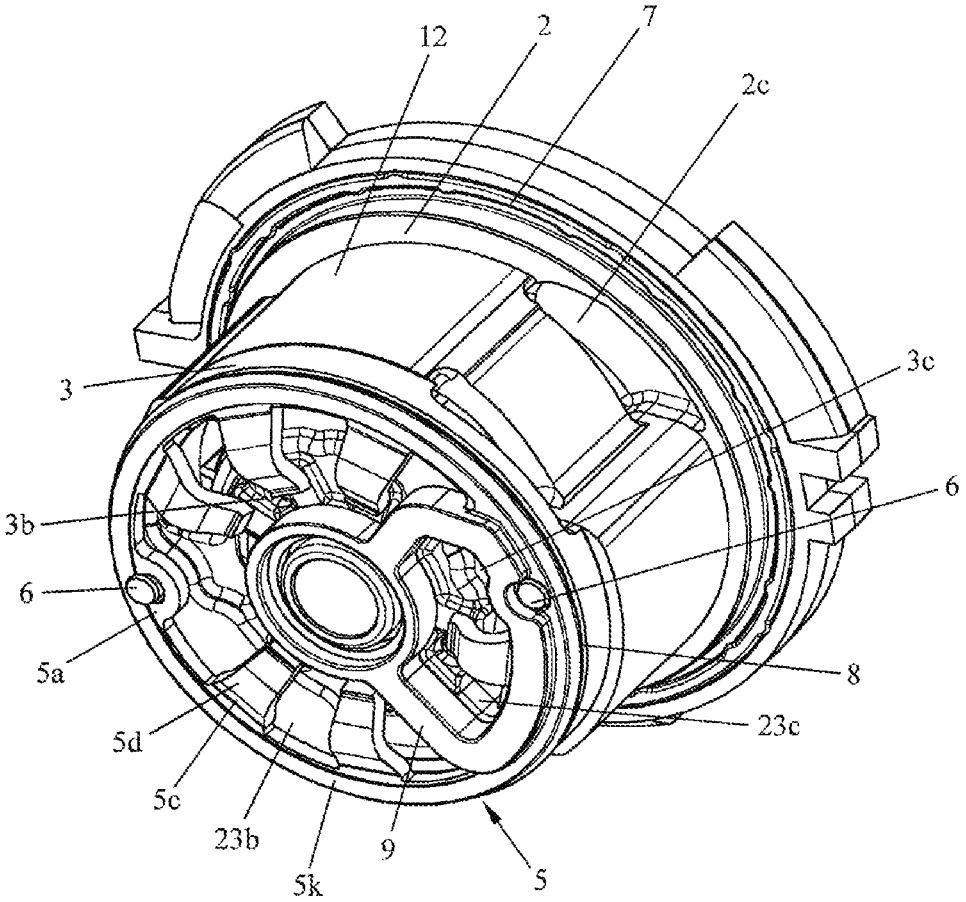
Figure 19:
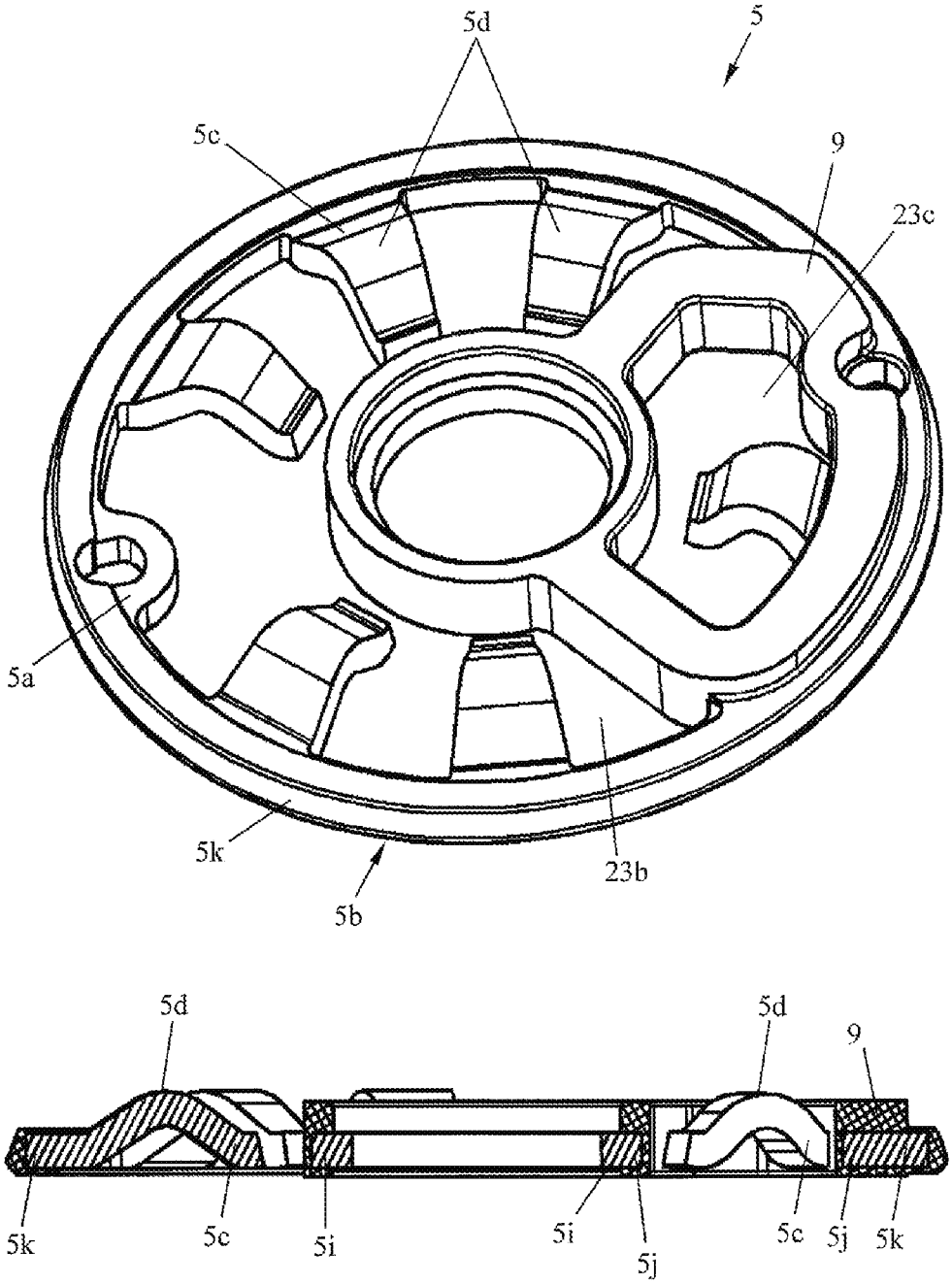

The invention has been described on the basis of a number of examples and embodiments, and in particular aspects. The developments of one aspect can also develop the other aspects, without however necessarily having to utilise the central concept of the other aspect. Particularly preferred embodiments of the invention are described on the basis of figures. The features thus disclosed, individually and in any combination of features, advantageously develop the subject-matter of the invention. There is shown:

FIG. 1 a detail of a sectional representation through a rotational axis of a rotor, wherein a pump insert is shown inserted into an accommodating housing;

FIG. 2 a sectional view of the pump insert from FIG. 1, through the rotational axis;

FIG. 3 a perspective view of the pump insert from FIG. 2;

FIGS. 4 and 5 embodiments of a spring for the pump assembly;

FIG. 6 another embodiment of a spring for the pump assembly;

FIG. 7 an embodiment of a spring for the pump assembly, exhibiting an O-ring-shaped cross-section;

FIG. 8 an embodiment of a spring for the pump assembly, exhibiting a C-ring-shaped cross-section;

FIG. 9 an embodiment of a seal which is arranged between the pump assembly and the accommodating housing;

FIG. 10 another embodiment of a seal;

FIG. 11 yet another embodiment of a seal;

FIG. 12 yet another embodiment of a seal;

FIG. 13 yet another embodiment of a seal;

FIG. 14 yet another embodiment of a seal;

FIG. 15 yet another embodiment of a seal;

FIG. 16 yet another embodiment of a seal;

FIG. 17 a pump insert, in a section along the rotational axis of the rotor, wherein the pump insert comprises a spring which is combined with a seal;

FIG. 18 a perspective view of the pump insert from FIG. 17;

FIG. 19 representations of the spring which is combined with the seal; and

Figure 20:
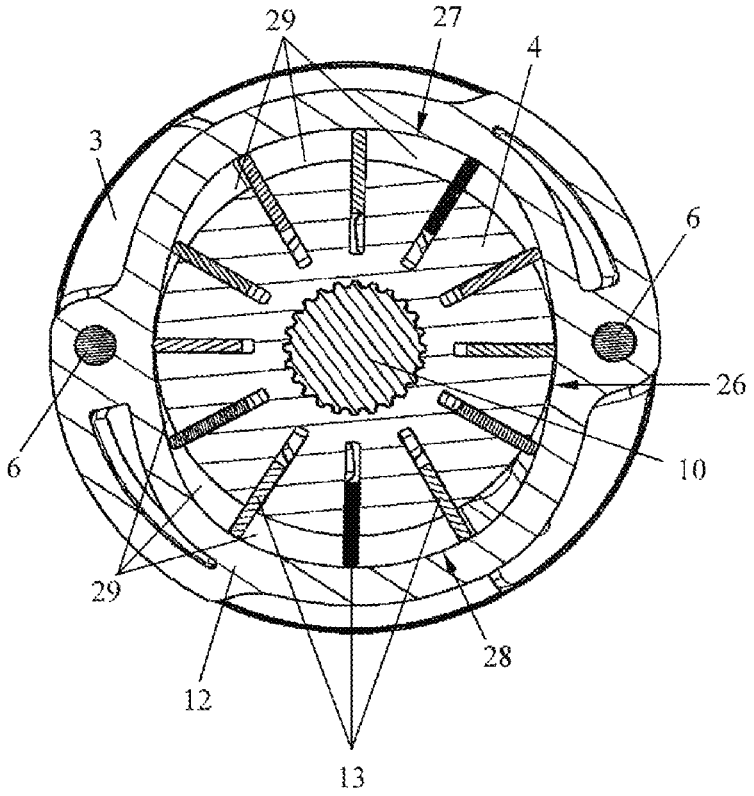

FIG. 20 an example of a cross-section through a pump insert, in the region of the rotor.

FIGS. 2, 3, 17 and 18 show pump inserts which can be inserted into an accommodating housing, as shown in FIG. 1. The pump, in particular the pump insert 1, comprises a spring 5 which is shown here in various embodiments. The pump or pump insert 1 can comprise a seal 9, in particular an axial seal, which is arranged between an end-facing wall 20*c* of an accommodating housing 20 and a second housing part 3. The seal 9 is shown in various embodiments, in some of which it is combined with the spring 5.

The pump or pump insert 1 comprises a rotor 4 which is non-rotationally connected to a pump shaft 10 via a shaft-hub connection 30. The rotor 4 comprises cavities which serve as a guide and are in particular slot-shaped. A delivery element 13, in particular a vane, is assigned to each cavity. The vane 13 can be shifted radially back and forth in its cavity, away from and towards the rotational axis R of the rotor 4, in particular guided with one translational degree of freedom, as can for example be seen from FIG. 20. The vanes 13 are rotated along with the rotor 4. The pump 1 comprises an annular housing part, namely a stroke ring 12. The stroke ring 12 is trapped between a first housing part 2 and a second housing part 3 and is non-rotational in relation to the first and second housing parts 2, 3. The space which extends annularly around the pump shaft 10, and which is surrounded by the inner circumference of the stroke ring 12 and axially delineated by the first and second housing parts 2, 3, can also be referred to as the pump chamber 26. The rotor 4 and the vanes 13 are arranged in the pump chamber 26.

As can best be seen from FIG. 20, at least one delivery chamber 27, 28 is formed radially between the rotor 4 and the stroke ring 12. The embodiment shown here comprises two delivery chambers 27, 28, namely a first delivery chamber 27 and a second delivery chamber 28 (FIG. 20).

A delivery cell 29 is respectively formed between adjacent vanes 13 and changes its volume as a function of the rotational position of the rotor 4 about its rotational axis R. Since the pump comprises a number of vanes 13, it also exhibits a corresponding number of delivery cells 29. A number of delivery cells 29 are situated in each of the delivery chambers 27, 28.

The vanes 13 and the rotor 4 form a first sealing gap with the first housing part 2 and a second sealing gap with the second housing part 3.

The stroke ring 12 and/or the vanes 13 can be magnetised, such that the vanes 13 abut the inner circumferential surface of the stroke ring 12 due to magnetic force, including in particular when the rotor 4 is not being rotated. This allows pressure to be built up in good time during a start or cold start, i.e. when the pump shaft 10 begins to be rotated. Alternatively or additionally, the vanes 13 can be pressed outwards, i.e. away from the rotational axis R of the rotor 4 and towards the inner circumferential surface of the stroke ring 12, due to the centrifugal force while the rotor 4 rotates. The vanes 13 and/or each of the vanes 13 forms a third sealing gap with the inner circumferential surface of the stroke ring 12.

The inner circumferential surface of the stroke ring 12 exhibits a contour which causes the vanes 13 to extend (increasing the volume of the delivery cell 29) at least once and to retract (decreasing the volume of the delivery cell 29) at least once during one complete revolution of the rotor 4. The pump shown in the example is a twin-stroke pump, i.e. comprises two delivery chambers 27, 28, wherein the vanes 13 for each delivery chamber 27, 28 extend once and retract once when they are moved through the delivery chamber 27, 28 by means of rotating the rotor 4. This means that the vanes 13 extend, retract, extend and retract again—in other words, extend twice and retract twice—during one complete revolution of the rotor 4. A delivery cell 29 is respectively formed between adjacent vanes 13 and is increased and/or decreased in volume by extending and retracting the vanes 13 which delineate it, namely as a function of the contour of the inner circumferential surface of the stroke ring 12.

As can be seen in particular from FIG. 3, the pump insert 1 comprises a first outlet channel 3*b* and a second outlet channel 3*c*, wherein the first outlet channel 3*b* ports into a first pressure space 23*b* and a first delivery chamber 27 (FIG. 20) and therefore connects the first delivery chamber 27 and the first pressure space 23*b* to each other in a liquid-guiding connection. The second outlet channel 3*c* ports into a second delivery chamber 28 and the second pressure space 23*c*, thus connecting the second delivery chamber 28 (FIG. 20) and the second pressure space 23*c* in a liquid-guiding connection. The first and second outlet channels 3*b*, 3*c* each port into the region of their respective delivery chamber 27, 28 in which the volume of the delivery cells 29 decreases while the rotor 4 rotates. This means that fluid, such as for example oil, situated in the delivery cells 29 is displaced through the outlet channels 3*b*, 3*c*.

The pump insert 1 comprises a first inlet channel 2*b* and a second inlet channel 2*c*, wherein the first inlet channel 2*b* ports into the first delivery chamber 27 and a suction space 24 and therefore connects the first delivery chamber 27 and the suction space 24 in a liquid-guiding connection, and wherein the second inlet channel 2*c* ports into the second delivery chamber 28 and the suction space 24 and therefore connects the second delivery chamber 28 and the suction space 24 in a liquid-guiding connection. The first and second inlet channels 2*b*, 2*c* each port into the region of their respective delivery chamber 27, 28 in which the volume of the delivery cells 29 increases while the rotor 4 rotates. This means that fluid is delivered or suctioned through the first and second inlet channels 2*b*, 2*c* into the expanding delivery cell 29.

When the rotor 4 rotates, fluid—in particular, liquid—is suctioned through the channel 2*b*, 2*c* into the expanding delivery cells 29 and transported into the region which the outlet channel 3*b*, 3*c* ports into, wherein the fluid is outputted from the then-contracting delivery cells 29 via the first outlet channel 3*b* and/or second outlet channel 3*c*.

The pump insert 1 comprises at least one positioning element 6 (two positioning elements 6 in the example shown). The positioning elements 6 are pins and/or are pin-shaped. The positioning element 6 is firmly anchored in the first housing part 2. The first housing part 2 comprises a blind bore 2*a* into which a first end of the pin-shaped positioning element 6 is pressed.

The pin-shaped positioning element 6 positions the second housing part 3 and the stroke ring 12 with respect to their angular positions about the rotational axis R relative to the first housing part 2. The second housing part 3 and the stroke ring 12 comprise cavities, apertures, bores or elongated holes, preferably exhibiting a radial extent, through which the positioning element 6 extends. In the example shown, the stroke ring 12 comprises a bore 12*a* for the first positioning element 6 and another bore 12*a* for the second positioning element 6 for this purpose. The second housing part 3 comprises a transit bore through which the positioning element 6 extends. The pin-shaped second end of the positioning element 6 protrudes past the end-facing side which points away from the pump chamber 26. This protruding portion of the positioning element 6 comprises a cavity, such as for example an annular groove 6*a*, or at least a part thereof, which extends over the circumference of the positioning element 6. A fastening element 5*a* of the spring 5 is arranged in the cavity 6*a* and fastened to the positioning element 6 and/or in the annular groove 6*a*, in particular in a force fit and/or positive fit. The fastening element 5*a* prevents the first housing part 2, the second housing part 3 and the stroke ring 12 from axially falling apart; in other words, it prevents the second housing part 3 and the stroke ring 12 from being removed from the positioning element 6. The spring 5 is thus also captively fastened to the pump insert 1, in particular the positioning elements 6.

The pump shaft 10 is rotatably mounted on the first and second housing part 2, 3, in particular by means of a slide bearing in each case. As an alternative to a pump shaft 10 which is mounted on both sides, the pump shaft 10 can manage without the mounting in the second housing part 3 or with only the mounting in the first housing part 2, in particular when the pump insert 1 is a twin-stroke pump insert, i.e. comprises two delivery chambers 27, 28 which for example lie opposite in relation to the rotational axis R. As a result, the forces transverse to the rotational axis R which are caused by the pressures in the delivery chambers 27, 28 can be approximately eliminated.

An outer structure, such as for example an outer toothed gearing, is formed on the pump shaft 10 between the portion of the pump shaft 10 which is rotatably mounted in the second housing part 3 and the portion of the pump shaft 10 which is rotatably mounted in the first housing part 2, and is in a positive-fit engagement with a corresponding inner structure, in particular an inner toothed gearing of the rotor 4, in order to form a shaft-hub connection 30. The outer diameter of the outer structure of the pump shaft 10 is larger than the diameter of the portion of the pump shaft 10 which is mounted in the first housing part 2 and/or in the second housing part 3. The pump shaft 10 is arranged, axially fixed, between the first and second housing parts 2, 3, i.e. such that shifting the pump shaft 10 along or in the direction of the rotational axis R is substantially impossible in both directions. For this purpose, the inner diameter of the portions of the first housing part 2 and second housing part 3 which mount the pump shaft 10 is smaller than the outer diameter of the outer structure of the pump shaft 10.

The end-facing side of the first housing part 2 which points away from the pump space 26 comprises an annular pocket in which a shaft seal 11 is arranged which is fastened, rotationally fixed, to the first housing part 2 and forms a sealing gap with the pump shaft 10. The shaft seal 11 seals off the pump space 26 with respect to the outside.

The end of the pump shaft 10 which lies opposite the end arranged in the region of the spring 5 comprises an outer structure for a shaft-hub connection 30 comprising a drive wheel, in particular a toothed wheel 21, in particular a sprocket. The toothed wheel 21 is seated non-rotationally on the pump shaft 10. The toothed wheel 21 can be driven by a chain which is in turn driven by for example a crankshaft or other shaft which can be connected to for example an engine of the vehicle. For fastening it to the pump shaft 10, the toothed wheel 21 comprises for example an inner thread via which it is screwed to an outer thread of the pump shaft 10, up against a collar of the pump shaft 10. A rotational securing device which is seated, secured against rotating, on the shaft 10 secures the toothed wheel 21 against becoming unintentionally detached. Alternatively, the drive wheel 21 can be joined or fastened to the pump shaft 10 by means of an interference fit assembly or other types of connection.

In the examples shown, the pump insert 1 is inserted into an accommodating housing, for example a cup-shaped accommodating housing 20, such as for example a housing cup (FIG. 1). The accommodating housing 20 comprises a circumferential wall 20*d* which circumferentially surrounds one of the pump inserts 1 shown here. The accommodating housing 20 also comprises an end-facing wall 20*c* which is monolithically connected to the circumferential wall 20*d*, wherein the spring 5 is supported on the end-facing wall 20*c*, in particular axially, i.e. in the direction of the rotational axis R.

The pump insert 1 is held between the end-facing wall 20*c* and an axial securing element, such as for example a screw, an axial securing ring, or a cover, such that the spring 5 is or is kept tensed, in particular pressurised. The axial securing element can in particular abut the first housing part 2 and/or hold the first housing part 2 on the accommodating housing 20, secured against shifting along or in the direction of the rotational axis R.

The first pressure space 23*b*, into which the fluid (liquid) delivered by the pump is delivered, is formed between the end-facing wall 20*c* and a second seal 8 which is arranged in an annular groove formed on the outer circumference of the second housing part 3 and which forms a sealing gap with the circumferential wall 20*d*. The pressure space 23*b* is in turn connected to a fluid consumer, such as for example a lubricant consumer, in particular a transmission, by means of a channel (not shown). An annular seal 9 which is arranged between the end-facing wall 20*c* and the second housing part 3 annularly surrounds the second pressure space 23*c* and seals it off in relation to the first pressure space 23*b*. The seal 9 therefore forms a wall of the first pressure space 23*b* and second pressure space 23*c*. The fluid delivered by the pump is delivered into the second pressure space 23*c*. The second pressure space 23*c* is in turn connected to a fluid consumer, such as for example a lubricant consumer, by means of a channel (not shown).

The seal 9 is arranged in a seal groove or seal pocket of the second housing part 3 which annularly surrounds one end of the second outlet channel 3*c*, wherein the base of the groove or pocket forms a sealing surface for the seal 9. The wall of the groove or pocket which annularly surrounds the seal exhibits a distance from the end-facing wall 20*c* which is less than the height of the seal 9, in particular less than the height of the first ring 9*a* which is described further below. Any gap extrusion of the seal 9 is prevented by the first ring 9*a*, in particular the material of the first ring 9*a*, and/or by the smaller gap width between the wall and the end-facing wall 20*c*. Gap extrusion can also be prevented by a supporting structure in the seal 9.

A suction space 24, from which fluid is delivered into the first pressure space 23*b* and/or the second pressure space 23*c* via the first delivery chamber 27 and the second delivery chamber 28, is formed between the second seal 8 and the first seal 7 which is arranged in an annular groove arranged on the outer circumference of the first housing part 2 and which forms a sealing gap with the circumferential wall 20*d*. The suction space 24 can for example be connected by means of a channel to a storage container for the fluid, into which the fluid consumed by the consumer can for example flow back. When the fluid is being delivered, the pressure in the pressure spaces 23*b*, 23*c* is increased as the rotational speed increases, whereby the second housing part 3 jams the stroke ring 12 firmly between the first and second housing part 2, 3, in addition to the biasing force of the spring 5. The first and second housing parts 2, 3 and the stroke ring 12 are thus sealed off with respect to each other. The connection between the axial securing element and the first housing part 2 is embodied to be strong enough that it can withstand, i.e. is not detached by, the axial force on the axial securing element, as generated by the pressure in the pressure spaces 23*b*, 23*c*. In the example shown, the axial securing element is a housing cover which is fastened to the accommodating housing 20 and on which the first housing part 2 is axially supported.

An expediently designed corrugated annular spring, a multi-corrugated spring disc, a tube spring or bow spring, a grooved annular spring, a metal O-ring or a metal C-ring may for example be considered for the spring 5. If the spring 5 is to be fastened to the positioning elements 6, the spring 5 can comprise fastening elements 5*a* for fastening it to the positioning elements 6.

FIG. 4 shows a first embodiment of a spring 5 which is embodied as a corrugated annular spring. The corrugated annular spring 5 comprises an annular spring structure 5*b* which is corrugated over its circumference, i.e. which comprises a number of corrugations, i.e. corrugation peaks and troughs. The corrugation peaks can for example abut the end-facing wall 20*c*, and the corrugation troughs can for example abut the second housing part 3. The corrugation height extends approximately parallel to the rotational axis R. The spring 5 is produced, in particular punched, from a flat material. The circumference of the spring 5 comprises a number of fastening elements 5*a* (in this case, two) in the form of cavities which are open towards the inner circumference and can be arranged in the annular groove 6*a* of a positioning element 6. The thickness of the flat material of the spring 5 is less than the groove width of the annular groove 6*a*. The spring 5 from FIG. 5 is to this extent identical to the spring 5 from FIG. 4. The spring 5 from FIG. 4 additionally comprises a number of inwardly protruding projections on its inner circumference. This enables the distribution of stress in the spring to be comparatively adapted in the event of deformation and/or the spring bias and spring rate to be adapted to requirements.

The spring 5 from FIG. 6 substantially corresponds to the embodiment from FIG. 5, wherein the spring structure 5*b* from FIG. 6 comprises more corrugations, i.e. is more significantly corrugated, than the embodiment from FIG. 5. In addition, the spring structure 5*b* comprises a positioning element 5*e* which can engage with a corresponding cavity in the second housing part 3 in order to fasten the spring 5 to the positioning elements 6 in the correct position.

FIG. 7 shows an annular spring 5 which comprises a number of tubular portions 5*f*—in this example, two tubular portions 5*f*—over its circumference. A fastening element 5*a*, in particular a flat portion 5*g* in which the fastening element 5*a* is formed, is arranged between adjacent tubular portions 5*f*. The fastening element 5*a* is a cavity which is open towards the inner circumference of the ring. The thickness of the flat portion 5*g* is less than the groove width of the annular groove 6*a* of the positioning element 6. The flat portion 5*g* can be formed by compressing and plastically deforming a previously continuous tubular portion 5*f*. In the example shown, two fastening elements 5*a* and therefore two flat portions 5*g* are provided. The spring 5 also comprises two tubular portions 5*f* which are respectively connected at their ends via a flat portion 5*g* which is provided with a fastening element 5*a*.

The embodiment from FIG. 8 shows a spring 5 which is identical to the spring from FIG. 7 except for the configuration of the tubular portions 5*f* For instead of a tubular portion 5*f*, the embodiment from FIG. 8 comprises C-shaped portions 5*h*. Reference is otherwise made to the embodiment from FIG. 7. The C-shaped portions 5*h* each exhibit a contour which has an open cross-section, i.e. a slot, which extends over the circumference, in particular the inner circumference of the annular spring structure.

The springs 5 and/or spring structures 5*b* from FIGS. 4 to 8 are preferably formed from metal, in particular spring steel. The springs 5 can additionally be coated, in particular in a plastic such as for example a polymer or an elastomeric or thermoplastic material or for example a varnish, or such materials can additionally be injection-moulded around the springs 5.

FIG. 9 shows an annular seal 9 which comprises a first sealing ring 9*a* made of a first material and a second sealing ring 9*b* made of a second material. The first ring 9*a* and second ring 9*b* can be integrally connected to each other, in particular in a material fit. The first ring 9*a* serves to stabilise the annular seal 9, wherein the second ring 9*b* primarily serves to ensure the sealing function. Reference can in principle be made here to EP 0 415 089 A2 in which such integral sealing rings are described. Plastic, in particular thermoplastics, which can be selected so as to exhibit the required characteristics, are suitable as the material for the first ring 9*a*. Polytetrafluoroethylene (PTFE) is in particular suitable; its core strength can be further increased using inlaid fibres, for example glass fibres, such that the axial seal can withstand significant pressures. Ethylene tetrafluoroethylene (ETFE) copolymer may also be considered as a material for the first ring 9*a*, not least because this material is easy to process. Polyterephthalate is also well suited to the envisaged purpose, since it can be easily vulcanised to the sealing ring. Polyamides, with or without inlaid glass fibres, are also suited to the envisaged purpose. The second ring 9*b* is preferably made of a plastic, in particular an elastomeric or rubbery-elastic material or elastomer, which can preferably be easily vulcanised, does not tear and does not exhibit high notch sensitivities. The materials listed also apply in particular, but not solely, to the embodiments from FIGS. 10, 11, 15 and 16, and can for example be used in any of the embodiments shown or described in the present application.

In FIG. 9, the first ring 9*a* comprises a groove, which extends in a V shape, over its circumference. A counter piece which is adapted to the shape of this groove and which is formed by the second ring 9*b* is arranged in the groove and connected, in particular vulcanised or glued, to the first ring 9*a* in the groove.

In FIG. 10, the first ring 9*a* again comprises a V-shaped groove which extends over the circumference of the first ring 9*a*; the second ring 9*b* is an O-ring which has a circular cross-section. The second ring 9*b* is again arranged in the V-shaped groove and connected to the first ring 9*a*, in particular in a material fit, in the groove. In the embodiment from FIG. 11, the first ring 9*a* comprises a planar surface which faces the second ring 9*b* and on which the O-ring-shaped second ring 9*b* lies and to which the second ring 9*b* is fastened in a material fit.

FIG. 15 shows a first ring 9*a* which comprises a tier circumferentially over its annular circumference, wherein the second ring 9*b*, which is embodied as an O-ring, is accommodated in said tier. The second ring 9*b* is connected to the first ring 9*a* in a material fit. Optionally, the second ring 9*b* is loosely inserted into the first ring 9*a*, in particular into the tiered collar.

The end-facing side of the end of the seal 9 which lies opposite the end-facing side of the end formed by the second ring 9*b* comprises at least one circumferential groove over the annular circumference of the first ring 9*a*. The groove is enclosed by a first, in particular inner circumferential groove wall 9*c* and a second, in particular outer circumferential groove wall 9*d*.

The first groove wall 9*c* is continuous over the circumference and supported on its sealing surface, forming a seal, thus sealing off the first pressure space 23*b* with respect to the second pressure space 23*c*. The second groove wall 9*d* is provided with a number of cavities over its circumference which make the second groove wall 9*d* permeable to liquid, hence only the first groove wall 9*c* seals off the pressure spaces. The second groove wall 9*d* serves to support the seal 9 on the sealing surface, so that the seal 9 does not tilt.

Alternatively, the second groove wall 9*d* can be continuous over the circumference, and the first groove wall 9*c* can be provided with the number of cavities, wherein the above description can be applied analogously to this embodiment, i.e. the second groove wall 9*d* can primarily serve a sealing function and the first groove wall 9*c* can primarily serve a supporting function.

FIG. 16 shows a seal 9 which consists of only one ring which is for example made of the material for the aforementioned first ring 9*a* or the aforementioned second ring 9*b*, depending on the expected pressure difference between the first pressure space 23*b* and the second pressure space 23*c*. An end-facing side of the end of the seal 9 is embodied with a sealing lip which comprises an inclined inner surface which is inclined such that an internal pressure in the second pressure space 23*c* exerts a force on the sealing lip, at least a portion of which presses against the sealing surface of the second housing part 3 or end-facing wall 20*c*. A multitude of cavities, which for example extend along the height of the seal 9 or in the direction of the rotational axis R, are arranged on the inner circumference and are for example open towards the inner circumference in order to ensure that pressure fluid from the second pressure space 23*c* is applied to the sealing lip, even when it is deformed when the pump insert 1 is incorporated in the accommodating housing 20, in order to press it against its sealing surface which is for example formed by the second housing part 3. The end-facing side of the seal 9 which lies opposite the sealing lip can be flat or level or embodied as in FIG. 15.

FIG. 12 shows an annular seal 9 which comprises a first ring 9*a* made of the aforementioned first material or alternatively made of metal, in particular steel. This first ring is coated substantially completely over its surface in plastic, in particular the elastomeric or rubbery-elastic or thermoplastic material, or said material is injection-moulded around it, thus forming a second ring 9*b*.

FIG. 13 shows an annular seal 9 which comprises a first ring 9*a* which is configured as an annularly circumferential tube. As an alternative to the materials mentioned for the first ring 9*a*, the ring 9*a* can for example consist of a metallic spring material, in particular spring steel. The annularly circumferential tube 9*a* can comprise a closed wall or can for example be wound from a helical spring.

The first ring 9*a* is coated over its outer circumference in plastic, in particular the elastomeric or rubbery-elastic or thermoplastic material, or said material is injection-moulded around it, thus forming a second ring 9*b* which surrounds the first ring 9*a*. The tube 9*a* from FIG. 13 can therefore act as a spring, and the coating or the surrounding injection-mould 9*b* can therefore act as a seal 9. The same applies analogously to the embodiment from FIG. 14.

The embodiment from FIG. 14 shows a first ring 9*a* which is formed from a slotted tube or C-shaped profile which is circumferential and shaped as a closed ring. The slot in the C-shaped profile or slotted tube 9*a* points towards the interior and therefore towards the second pressure space 23*c*. The first ring 9*a* is coated over its outer circumference in plastic, in particular the elastomeric or rubbery-elastic or thermoplastic material, or said material is injection-moulded around it, thus resulting in a second ring 9*b* which at least partially surrounds the first ring 9*a*.

FIG. 19 shows an embodiment of a spring 5 which is combined with a seal 9 and which is shown in FIGS. 17 and 18 in combination with the pump insert 1.

The spring 5 from FIG. 19 comprises an annular spring structure 5*b* featuring a first spring structure ring 5*k* which extends, in particular concentrically, around the rotational axis R. The spring structure 5*b* is formed from metal, in particular steel, which imbues the spring 5 with its essential spring characteristics in the direction of the rotational axis R. The annular spring structure 5*b* comprises a number of arms 5*c* which protrude inwards from the first spring structure ring 5*k* and are distributed over its circumference, wherein the inwardly protruding ends of the arms project freely. The arms 5*c* each comprise a contact surface 5*d* via which they abut the end-facing wall 20*c*. The lower side of the first spring structure ring 5*k* of the spring structure 5*b* abuts the second housing part 3 in the region which is arranged in axial alignment with the stroke ring 12 in the direction of the rotational axis R. The first spring structure ring 5*k* comprises two fastening elements 5*a* which are formed as continuous cavities, such as for example bores or elongated holes. The bore or elongated hole is surrounded, over at least some of its circumference, by a wall which exhibits a thickness, extending along or in the direction of the rotational axis R, which is smaller than the groove width of the annular groove 6*a* of the positioning element 6. A part of this wall can thus latch into the annular groove 6*a*, thus captively fastening the spring 5 to the at least one positioning element 6. For inserting the positioning elements 6 into the continuous cavities of the fastening elements 5*a*, the spring structure ring 5*k* can for example be elastically pressed together or apart along an imaginary connecting line between the two fastening elements 5*a*, in order to enable it to be fitted onto the positioning elements 6 and, by releasing it, enable a part of the wall to latch into the annular groove 6*a*.

The spring structure 5*b* comprises a second spring structure ring 5*j* which annularly surrounds the second pressure space 23*c*. The spring structure 5*b* also comprises a third spring structure ring 5*i* which extends around the rotational axis R and is arranged within the first spring structure ring 5*k* from which the arms 5*c* project. At least the second spring structure ring 5*j* and preferably—if provided—also the third spring structure ring 5*i* and optionally also the first spring structure ring 5*k* is/are coated in plastic, in particular the elastomeric or rubbery-elastic or thermoplastic material, or said material is injection-moulded around it/them at least partially or completely, such that at least the ends of the second ring (which comprises the second spring structure ring 5*j*) and third ring (which comprises the third spring structure ring 5*i*) which point in the direction of the rotational axis R are formed with a surface made of plastic, in particular the elastomeric or rubbery-elastic or thermoplastic material. The elastomeric or rubbery-elastic or thermoplastic material also separates the second pressure space 23*c* from the first pressure space 23*b*. The second ring, together with its surrounding injection-mould or coating, can therefore be defined as a seal 9. The third ring, together with its coating or surrounding injection-mould, seals off the bore in the second housing part 3, in which a portion of the pump shaft 10 is arranged, with respect to the first pressure space 23*b* and the second pressure space 23*c*. The surrounding injection-mould or coating of the third ring is supported on the second housing part 3 and oppositely on the end-facing wall 20*c*.

LIST OF REFERENCE SIGNS

1 pump insert
2 first housing part
2*a* cavity, such as for example a blind bore
2*b* first inlet channel
2*c* second inlet channel
3 second housing part
3*a* cavity, such as for example a transit bore
3*b* first outlet channel
3*c* second outlet channel
4 rotor
5 spring
5*a* securing element/fastening element
5*b* spring structure
5*c* arm
5*d* contact surface
5*e* positioning element
5*f* tubular portion
5*g* flat portion
5*h* slotted tubular portion
5*i* third spring structure ring
5*j* second spring structure ring
5*k* first spring structure ring
6 positioning element/pin
6*a* cavity, such as for example an annular groove
7 first seal/sealing ring
8 second seal/sealing ring
9 sealing element/seal/sealing ring/axial seal
9*a* first ring
9*b* second ring
9*c* first groove wall
9*d* second groove wall
10 pump shaft
11 shaft seal
12 stroke ring
12*a* bore
13 delivery element/vane
20 accommodating housing, such as for example a housing cup
20*c* end-facing wall
20*d* circumferential wall
20*e* opening
21 toothed wheel, such as for example a sprocket
23*b* first pressure space
23*c* second pressure space
24 suction space

25 accommodating space
26 pump space/pump chamber
27 first delivery chamber
28 second delivery chamber
29 delivery cell
30 shaft-hub connection
R rotational axis

The invention claimed is:

1. A pump, comprising:

an accommodating housing which forms a cup-shaped accommodating space comprising an end-facing wall and a circumferential wall; and a pump insert which is arranged in the accommodating space, wherein the pump insert comprises:

a rotor;

a first housing part and a second housing part, between which the rotor is arranged such that it rotates about a rotational axis and relative to the first and second housing part;

a stroke ring which surrounds the rotor and is arranged between the first housing part and the second housing part; and at least one positioning element which positions the second housing part with respect to its angular position about the rotational axis relative to the first housing part, wherein a spring which is fastened to the at least one positioning element and which flexes along or in the direction of the rotational axis is arranged between the accommodating housing and the second housing part, wherein the spring comprises a spring structure which is made of metal and which imbues the spring with its essential spring characteristics along or in the direction of the rotational axis , and wherein the spring is supported on the end-facing wall of the accommodating housing and towards the second housing part, in a region which is arranged in axial alignment with the stroke ring in the direction of the rotational axis, and thus presses the second housing part against the stroke ring.

2. The pump according to claim 1, characterised in that the spring is supported on the second housing part.

3. The pump according to claim 1, characterised in that the spring is supported on the end facing wall in a region which is arranged in axial alignment with the stroke ring in the direction of the rotational axis.

4. The pump according to claim 1, characterised in that the spring is annular and at least partially surrounds a pressure space which is connected to a delivery chamber, in which the rotor is arranged, via an outlet channel formed by the second housing part.

5. The pump according to claim 4, characterised in that a sealing element which surrounds the pressure space is arranged between the second housing part and an end-facing wall of the accommodating housing.

6. The pump according to claim 4, characterised in that the pressure space is a second pressure space, wherein a first pressure space is formed between the end-facing wall of the accommodating housing and the second housing part, wherein the sealing element seals off the first pressure space and the second pressure space in relation to each other.

7. The pump according to claim 6, characterised in that the pump is a multi-stroke pump wherein the first pressure space is connected via a first outlet channel to a first delivery chamber, and the second pressure space is connected via a second outlet channel to a second delivery chamber, in a liquid-guiding connection.

8. The pump according to claim 6, characterised in that a seal which is arranged between the second housing part and the accommodating housing seals off the first pressure space which is formed between the end-facing wall and the second housing part in relation to a suction space which is formed between the circumferential wall and the stroke ring, wherein the suction space is connected in a liquid-guiding connection to the at least one delivery chamber by means of at least one inlet channel.

9. The pump according to claim 1, characterised in that the spring is one of the following:

a corrugated annular spring;

a multi-corrugated spring disc;

a tube spring or bow spring;

a grooved annular spring;

a metal C-ring; or a metal O-ring.

* * * * *